US007047941B2

(12) United States Patent
Draper et al.

(10) Patent No.: US 7,047,941 B2
(45) Date of Patent: May 23, 2006

(54) FUEL INJECTION SYSTEM

(75) Inventors: David E. Draper, Bridgnorth (GB); Anthony T. Harcombe, Richmond (GB); Andrew R. Knight, Horsley Stroud (GB); Lukhbir S. Panesar, Feltham (GB)

(73) Assignee: Delphi Technologies, Inc., Troy, MI (US)

( * ) Notice: Subject to any disclaimer, the term of this patent is extended or adjusted under 35 U.S.C. 154(b) by 148 days.

(21) Appl. No.: 10/427,229

(22) Filed: May 1, 2003

(65) Prior Publication Data

US 2004/0025846 A1 Feb. 12, 2004

(51) Int. Cl.
*F02M 1/00* (2006.01)
*F02M 47/02* (2006.01)

(52) U.S. Cl. ..... 123/447; 123/457

(58) Field of Classification Search ..... 123/447, 123/457, 459, 495, 506, 508, 510, 511
See application file for complete search history.

(56) References Cited

U.S. PATENT DOCUMENTS

| | | | | |
|---|---|---|---|---|
| 4,784,101 | A * | 11/1988 | Iwanaga et al. | 123/446 |
| 4,811,715 | A | 3/1989 | Djordjevic et al. | |
| 5,078,113 | A | 1/1992 | Haag et al. | |
| 5,826,561 | A * | 10/1998 | Mack et al. | 123/446 |
| 5,960,627 | A | 10/1999 | Krampe et al. | |
| 6,405,745 | B1 | 6/2002 | Kar et al. | |
| 6,439,202 | B1 | 8/2002 | Carroll, III et al. | |
| 6,453,875 | B1 | 9/2002 | Mahr et al. | |
| 6,513,733 | B1 | 2/2003 | Lambert | |
| 6,516,784 | B1 * | 2/2003 | Shingu | 123/450 |
| 6,520,150 | B1 * | 2/2003 | West | 123/446 |
| 6,540,160 | B1 * | 4/2003 | Rodriguez-Amaya et al. | 239/533.2 |
| 6,651,626 | B1 * | 11/2003 | Rodriguez-Amaya et al. | 123/447 |
| 6,659,086 | B1 * | 12/2003 | Rodriguez-Amaya et al. | 123/467 |
| 6,684,854 | B1 * | 2/2004 | Coldren et al. | 123/446 |
| 6,688,278 | B1 * | 2/2004 | Rodriguez-Amaya et al. | 123/299 |
| 6,688,289 | B1 * | 2/2004 | Rodriguez-Amaya et al. | 123/467 |
| 6,725,840 | B1 * | 4/2004 | Mahr et al. | 123/467 |
| 6,763,809 | B1 * | 7/2004 | Grabandt | 123/467 |
| 6,796,290 | B1 * | 9/2004 | Boehland et al. | 123/446 |
| 6,808,124 | B1 * | 10/2004 | Egler | 239/88 |
| 6,843,053 | B1 * | 1/2005 | Draper et al. | 60/274 |
| 6,854,962 | B1 * | 2/2005 | Spoolstra et al. | 417/53 |
| 6,908,043 | B1 * | 6/2005 | Boecking | 239/88 |
| 2002/0148435 | A1 | 10/2002 | Kohketsu et al. | |

FOREIGN PATENT DOCUMENTS

| | | | |
|---|---|---|---|
| DE | 4118236 | A1 | 12/1991 |
| DE | 19636507 | A1 | 9/1995 |

(Continued)

*Primary Examiner*—Hai Huynh
(74) *Attorney, Agent, or Firm*—David P. Wood

(57) ABSTRACT

A fuel injection system for supplying pressurized fuel to a fuel injector, the fuel injection system comprising an accumulator volume for supplying fuel at a first injectable pressure level to the fuel injector through a fuel supply passage, a pump arrangement for increasing the pressure of fuel supplied to the injector to a second injectable pressure level, and a valve arrangement operable between a first position in which fuel at the first injectable pressure level is supplied to the injector and a second position in which communication between the injector and the accumulator volume is broken so as to permit fuel at the second injectable pressure to be supplied to the injector. The injection system may include a valve arrangement in the form of a three-position valve or may include a shut off valve for controlling the supply of fuel through the fuel supply passage.

44 Claims, 11 Drawing Sheets

FOREIGN PATENT DOCUMENTS

| | | | |
|---|---|---|---|
| DE | 199 39 428 | A1 | 3/2001 |
| DE | 101 48 995 | A1 | 4/2003 |
| EP | 0315564 | A1 | 10/1988 |
| EP | 0381954 | A1 | 1/1990 |
| EP | 1022452 | A2 | 7/2000 |
| EP | 1247969 | | 10/2002 |
| EP | 1273797 | A2 | 1/2003 |
| EP | 1 359 316 | * | 11/2003 |
| GB | 2310889 | A | 9/1997 |
| GB | 2353327 | | 2/2001 |
| WO | 0055498 | | 9/2000 |
| WO | 0114709 | | 3/2001 |
| WO | 0114737 | | 3/2001 |
| WO | WO 02/055869 | A1 | 7/2002 |

* cited by examiner

FUEL INJECTION SYSTEM

FIELD OF THE INVENTION

The present invention relates to a fuel injection system for an internal combustion engine, and in particular to a fuel injection system including an accumulator volume in the form of a common rail. The fuel system of the present invention is capable of providing a range of injection pressure and injection-rate shaping characteristics. The invention also relates to a common rail fuel system including a shut off valve, and to a shut off valve for use in a fuel injection system.

BACKGROUND OF THE INVENTION

In known fuel injector designs, a nozzle control valve is provided to control movement of a fuel injector valve needle relative to a seating and, thus, to control the delivery of fuel from the injector. A so-called Electronic Unit Injector (EUI) is an example of such an injector. An Electronic Unit Injector includes a dedicated pump having a cam-driven plunger for raising fuel pressure within a pump chamber, and an injection nozzle through which fuel is injected into an associated engine cylinder. A spill valve is operable to control the pressure of the fuel within the pump chamber. When the spill valve is in an open position, the pump chamber communicates with a low pressure fuel reservoir so that fuel pressure within the pump chamber is not substantially affected by movement of the plunger and fuel is simply drawn into and displaced from the pump chamber as the plunger reciprocates. Closure of the spill valve causes pressure in the pump chamber to rise as the plunger is driven to reduce the volume of the pump chamber. Each Electronic Unit Injector has an electronically controlled nozzle control valve that is arranged to control the timing of commencement and termination of the injection of fuel into an associated engine cylinder. Typically, the engine is provided with a plurality of Electronic Unit Injectors, one for each cylinder of the engine.

Although the use of a nozzle control valve in an Electronic Unit Injector provides a capability for controlling the injection timing, and such units are capable of achieving high injection pressures, both injection pressure and injection timing are limited to some extent by the nature of the associated cam drive.

In common rail fuel injection systems, a single pump is arranged to charge an accumulator volume, or common rail, with high pressure fuel for supply to a plurality of injectors of the fuel system. As in an Electronic Unit Injector, the timing of injection is controlled by means of a nozzle control valve associated with each injector. One advantage of the common rail system is that the timing of injection of fuel at high pressure is not dependent upon a cam drive, and so fast and accurate control of the timing of injection can be achieved with the nozzle control valves. However, achieving very high injection pressure within a common rail system is problematic and the high levels to which fuel must be pressurised can cause high stresses within the pump and within the rail. The rail must therefore be provided with a relatively thick wall for pressure containment, making it heavy and bulky. Parasitic fuel losses can also be high.

It has been recognised that significant improvements in combustion quality and efficiency may be achieved by rapidly varying the injection pressure level and injection rate within an injection event. Such variations in the injection characteristics can be difficult to achieve rapidly with both Electronic Unit Injector systems and common rail systems, and the efficiency of both types of system is limited. For example, in a common rail system designed to achieve injection at a high rail pressure, it is also possible to achieve a lower injection pressure by relieving some of the high pressure fuel to a low pressure reservoir. This, however, is an inefficient use of pumping energy.

It is a feature of common rail systems that in order to terminate injection it is usually necessary to apply a high hydraulic force to the back end of the injector valve needle, and this is achieved through operation of the nozzle control valve. It has been found, however, that this results in a disruption of the fuel spray formation into the engine cylinder, and produces an unnecessary degree of smoke.

The present invention is aimed at one or more of the problems set forth above.

SUMMARY OF THE INVENTION AND ADVANTAGES

It is one aim of the present invention to provide a fuel injection system which substantially overcomes or alleviates at least one of the aforementioned limitations and disadvantages of common rail and Electronic Unit Injector fuel injection systems. It is a further aim of the invention to provide a fuel injection system having a capability for achieving injection at a range of injection pressures, and with accurate and efficient control of the injection timing and rate. It is a still further aim of the present invention to overcome or alleviate the aforementioned fuel spray degradation problem that is associated with termination of injection in common rail and Electronic Unit Injector fuel systems.

According to the present invention there is provided a fuel injection system for supplying pressurised fuel to a fuel injector, the fuel injection system comprising an accumulator volume for supplying fuel at a first injectable pressure level to the fuel injector through a fuel supply passage, pump means, in the form of a pump arrangement, for increasing the pressure of fuel supplied to the injector to a second injectable pressure level, and valve means, in the form of a valve arrangement, operable between a first position in which fuel at the first injectable pressure level is supplied to the injector and a second position in which communication between the injector and the accumulator volume is broken so as to permit fuel at the second injectable pressure to be supplied to the injector.

Preferably, the pump means is arranged, at least in part, within the high pressure fuel supply passage.

One advantage of the invention is the ability to control the injection of fuel at different pressure levels, without the need to relieve high pressure fuel to low pressure. The system therefore has improved efficiency over known common rail fuel systems. The accumulator volume may be charged with fuel at a moderate pressure of, say, 300 bar, and the pump means may be arranged to increase rail pressure further to, say, between 2000 and 2500 bar. Within one engine cycle it is therefore possible to vary the pressure of the injected fuel (and thereby the injection rate), and this has important implications for emissions levels. For example, it has been found that a two-stage injection including a pilot injection of fuel at a first, moderate pressure level followed by a main injection of fuel at a second, higher pressure level can help to reduce pollutant emissions and noise. This can be achieved relatively easily and efficiently using the fuel system of the present invention.

It is a particular benefit of being able to inject at two pressure levels, that a sequence of a main injection of fuel having the second (higher) pressure level followed by a post injection of fuel having the first (moderate) pressure level can be achieved and this can have benefits for after-treatment purposes.

The pump means and the injector may be combined in a so-called "unit pump/injector arrangement", wherein the pump components and the injector components are arranged within a common housing.

In a preferred embodiment, the pump means include a pump chamber defined within a plunger bore, and a plunger which is movable within the plunger bore to perform a pumping cycle having a pumping stroke and a return stroke. During the plunger pumping stroke, pressurisation of fuel occurs within the pump chamber. During the plunger return stroke, the pumping chamber is filled with fuel to be pressurised during the following pumping stroke. Conveniently, the pump chamber may be arranged to form part of the high pressure supply line to the injector.

The pump means is preferably driven by means of a cam arrangement.

In one embodiment, the cam arrangement may include a cam having a first cam lobe and at least one further cam lobe, whereby the first cam lobe effects pressurisation of fuel within the pump chamber to the second (higher) pressure level during at least a part of a first pumping stroke of the plunger, and a further one of the lobes effects pressurisation of fuel within the pump chamber to the first (moderate or rail) pressure level during a further pumping stroke of the plunger.

Conveniently, pressurisation of fuel to the first pressure level by means of the further pumping stroke of the plunger occurs during a period for which injection is not occurring at the second pressure level.

It may be desirable for the first pumping stroke to be used to supplement pressurisation to the first pressure level also, by operating the valve means at an appropriate stage of this stroke.

Typically, the fuel injection system includes a plurality of injectors, each having an associated pumping plunger, and whereby each of said plungers is driven by means of an associated cam that is oriented relative to the or each of the other cams and has a surface shaped such that the associated return stroke is interrupted to define at least one step of plunger movement that is substantially synchronous with the pumping stroke of one of the other plungers.

Preferably, each cam surface is shaped to include a rising flank, and wherein the remainder of the cam surface includes a surface irregularity which serves to define an interval of interruption in the return stroke of the associated plunger.

Preferably, each cam is driven by means of a shaft, in use, and each cam surface is shaped to define a number of steps of movement through the associated return stroke that is equal to the number of other cams in the system that are driven by the same shaft.

In a preferred embodiment, the valve means includes an electrically operable valve member which is movable between the first and second positions by application of an electronic control signal.

In one embodiment, the valve means includes a rail control valve for controlling communication between the pump means and the accumulator volume.

When injection is occurring at the second injectable pressure level, it is possible to terminate injection by opening the rail control valve, thereby to relieve high fuel pressure in the supply passage to rail pressure.

In an alternative embodiment, the valve means includes a three-position valve that is operable between the first and second positions and a further, third position in which the pump means communicates with a low pressure drain, thereby to permit spill-end of injection.

The provision of the three-position valve in the system is advantageous as it permits high pressure fuel within the pump chamber, and hence within the high pressure supply passage to the injector, to be relieved to the low pressure drain. In this way, injection of fuel at the first, moderate pressure level can be terminated by means other than a nozzle or needle control valve that may be associated with the valve needle. In a spill-end of injection, the injector valve needle is not forced to close against a high hydraulic force within the injection nozzle, thereby providing an improved fuel spray formation at the end of injection.

In one embodiment, the three-position valve includes an inner valve member and an outer valve member, and associated inner and outer valve spring means, whereby movement of the inner and outer valve members is effected by means of a winding of an electromagnetic actuator.

In one preferred embodiment, the outer valve member is coupled to an armature of the actuator, said outer valve member being movable relative to the inner valve member and being movable into engagement with a first valve seating defined by the inner valve member upon energisation of the winding to a first energisation level, thereby to move the valve means into the third position of the valve means, said movement of the outer valve member being coupled to the inner valve member to move the valve means into its second position upon energisation of the winding to a second energisation level.

The fuel injection system may, in one embodiment, comprise a high pressure fuel pump for supplying fuel at the first injectable pressure level to the accumulator volume.

In an alternative embodiment, the pump means may be operable to supply pressurised fuel, at the first injectable pressure level (P1), to the accumulator volume. If the pump means is configured to provide fuel to the accumulator volume, the need for the high pressure pump is removed, thereby reducing the cost of the system.

If no high pressure fuel pump is provided, the valve means may further include an additional valve for controlling a supply of fuel at relatively low pressure the pump means, for example to the pump chamber of the pump means.

The additional valve may take the form of a fill/spill valve that is actuable between an open position, in which the pump means communicates with the supply of fuel at relatively low pressure, and a closed position in which said communication is broken, and whereby actuation of the fill/spill valve to the open position during a pumping stroke permits a spill-end of injection.

Alternatively, the additional valve may take the form of a non-return valve having an open position, in which the pump means communicates with the supply of fuel at relatively low pressure, and a closed position in which said communication is broken.

If no high pressure fuel pump is provided, the fuel injection system may further comprise a transfer pump for supplying fuel at relatively low pressure to the pump means.

The fuel injection system may include control valve means, in the form of a control valve arrangement, operable to control the timing of commencement of injection at the first and/or second injectable pressure level. The control valve means may, in a first embodiment, include a nozzle control valve that is operable to control fuel pressure within an injector control chamber so as to permit control of injection timing of at the first and/or second injectable pressure level.

The injector may include a valve needle that itself has a surface exposed to fuel pressure within the control chamber, so that by controlling fuel pressure within the control chamber by means of the nozzle control valve opening and closure of the valve needle can be controlled.

In a preferred embodiment, however, the control valve means includes a shut off control valve, including a shut off valve member, for controlling the supply of fuel between the pump means and the injector, thereby to permit control of injection timing at the first and/or second injectable pressure level.

In one particularly preferred embodiment of the invention, therefore, there is provided a fuel injection system for supplying pressurised fuel to a fuel injector wherein said system comprises an accumulator volume for supplying fuel at a first injectable pressure level to the fuel injector through a fuel supply passage, pump means for increasing the pressure of fuel supplied to the injector to a second injectable pressure level, valve means operable between a first position in which fuel at the first injectable pressure level is supplied to the injector and a second position in which communication between the injector and the accumulator volume is broken so as to permit fuel at the second injectable pressure to be supplied to the injector, and control valve means including a shut off control valve having a shut off valve member, for controlling the supply of fuel between the pump means and the injector, thereby to enable control of injection timing at the first and/or second injectable pressure level.

The control valve means may preferably include a control valve for controlling fuel pressure within a shut off valve control chamber, wherein a surface associated with the shut off control valve member is exposed to fuel pressure within the shut off control chamber.

The pump means may further comprise a drive member, such as a tappet, which is co-operable with the plunger, and a cam follower for driving the drive member in response to rotation of the cam, thereby to drive plunger movement.

In one embodiment, the drive member is not coupled to a rocker arm of the engine but the cam bears directly on a follower associated with the plunger.

It is a further feature of the present invention that engine valve timing and fuel pressurisation can be accomplished using the same cam drive.

In one embodiment, the pump means may further comprise a drive member which is co-operable with the plunger, wherein the drive member is coupled to a rocker arm of the engine such that movement of the drive member imparts pivotal movement to the rocker arm.

In one embodiment, the accumulator volume takes the form of a common rail.

The common rail may be comprised in another engine component, for example a hollow engine rocker shaft or an engine cylinder head.

Due to the provision of the pump means in the fuel injection system, fuel within the common rail need only be charged to a relatively modest pressure (i.e. the first pressure level), and so the rail can be a thinner walled vessel or container having reduced weight and bulk. It is therefore possible to situate the common rail inside another component, for example inside a hollow rocker shaft or an engine cylinder head.

In one embodiment, the accumulator volume is comprised in a rocker shaft of the associated engine.

By way of example, the pump means may be operable to raise fuel pressure to a second injectable pressure level in the range of 2000 and 2500 bar, and fuel in the accumulator volume may be at a pressure level of between 200 and 300 bar.

Typically, the second injectable pressure is between about 5 and 10 times higher than the first injectable pressure level.

According to a second aspect of the invention, a shut off control valve for use in a fuel injection system including an injector, the shut off valve control valve including a shut off valve member that is operable between open and closed operating positions to control the supply of fuel to the injector, the shut off control valve member having a surface exposed to fuel pressure within a shut off control chamber, the shut off valve further comprising a control valve for controlling fuel pressure within the shut off valve control chamber, thereby to control movement of the shut off valve member between the open and closed operating positions.

Preferably, the shut off valve member is arranged within a fuel supply passage to the injector and such that an associated first surface of the shut off valve member defines a first effective surface area that is exposed to fuel pressure within the shut off control chamber and an associated second surface of the shut off valve member defines a second effective surface area, whereby the associated second surface of the shut off valve member is engageable with a shut off valve seating to control fuel flow through the fuel supply passage.

Conveniently, the hydraulic force acting on the first effective surface area opposes the hydraulic force acting on the second effective surface area.

In one preferred embodiment, the associated second surface defines a seating surface of substantially conical form for engagement with the shut off valve seating.

Preferably, for example, the associated first surface is defined by a first end region of the shut off valve member and an opposite end region of the shut off valve member is exposed to relatively low fuel pressure.

In this embodiment the associated second surface may be defined by an intermediate region of the shut off valve member.

In a further preferred embodiment the shut off valve member is shaped such that any force imbalance on the shut off valve member is substantially the same when the shut off valve member is in both its open and closed operating positions.

It has been found that a shut off valve of this configuration has improved force balancing, as any out of balance forces that act on the shut off valve member are substantially the same when the shut off valve member is in both the open and closed operating positions. This characteristic is particularly beneficial for achieving a pilot injection of fuel or any other injection of relatively small fuel volume.

Preferably, the shut off valve member is slideable within a bore in a valve housing and is shaped to define, together with the bore, an annular chamber through which high pressure fuel flows when the shut off valve member is in the open operating position.

The shut off valve seating may be substantially flat and is defined by a step in a housing bore within which the shut off valve member moves. Alternatively the shut off valve seating or may be of frusto-conical form.

In an alternative embodiment of the shut off valve, the associated first surface is defined by a first end of the shut off valve member and the associated second surface is defined by an opposite end of the shut off valve member. In this case the associated second surface may be engageable with a shut off valve seating defined by an end face of a housing part.

The shut off valve member may be substantially pressure balanced, and preferably may then include spring means, in the form of a spring arrangement (for example a compression spring), for urging the shut off valve member towards its closed position.

However, the shut off valve need not be pressure balanced, in which case the effective surface area of the first associated surface may be greater than the effective surface area of the second associated surface.

Preferably, the control valve is operable between a first position in which the shut off valve control chamber communicates with fuel at an injectable pressure and a second position in which the shut off valve control chamber communicates with fuel at a relatively low pressure. If the shut-off valve is implemented in a fuel injection system in accordance with the first aspect of the invention, the injectable pressure may be the first, moderate pressure level, or may be the second higher pressure level. It will be appreciated, however, that the shut-off valve of this second aspect of the invention may also be implemented in a fuel injection system other than of the type described herein.

In an alternative embodiment, the control valve is operable between a first position in which the shut off valve control chamber communicates with fuel at a pressure level that is different to the injectable pressure level and a second position in which the shut off valve control chamber communicates with fuel at a relatively low pressure.

According to a third aspect of the invention, a fuel injector for use in an internal combustion engine includes an injection nozzle having a valve needle and a valve needle seating, said valve needle being movable between an open position in which it is lifted away from the valve needle seating and a closed position in which is engaged with the valve needle seating, a fuel supply passage and a shut off control valve that is actuable between an open position in which high pressure fuel flows through the fuel supply passage to the injection nozzle and a closed position in which high pressure fuel cannot flow through the fuel supply passage to the injection nozzle, and whereby the shut off valve is actuable between its open and closed position with the valve needle is in its open position so as to provide a pulsed injection of fuel to the injector.

The fuel injector incorporating the shut off valve permits a pulsed injection of fuel to be achieved, without the requirement to re-seat the valve needle between the injected pulses. This enables a rapid pulsing of fuel injection, and is particular useful for achieving a pilot injection of fuel followed by a main injection of fuel.

It will be appreciated that any one or more of the preferred and/or optional features described previously for the shut off valve of the second aspect of the invention may be included as preferred or optional features of the fuel injector of the third aspect of the invention also. Likewise, the preferred and/or optional features of the second or third aspects of the invention may be incorporated as preferred and/or optional features in the fuel injection system of the first aspect of the invention also.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
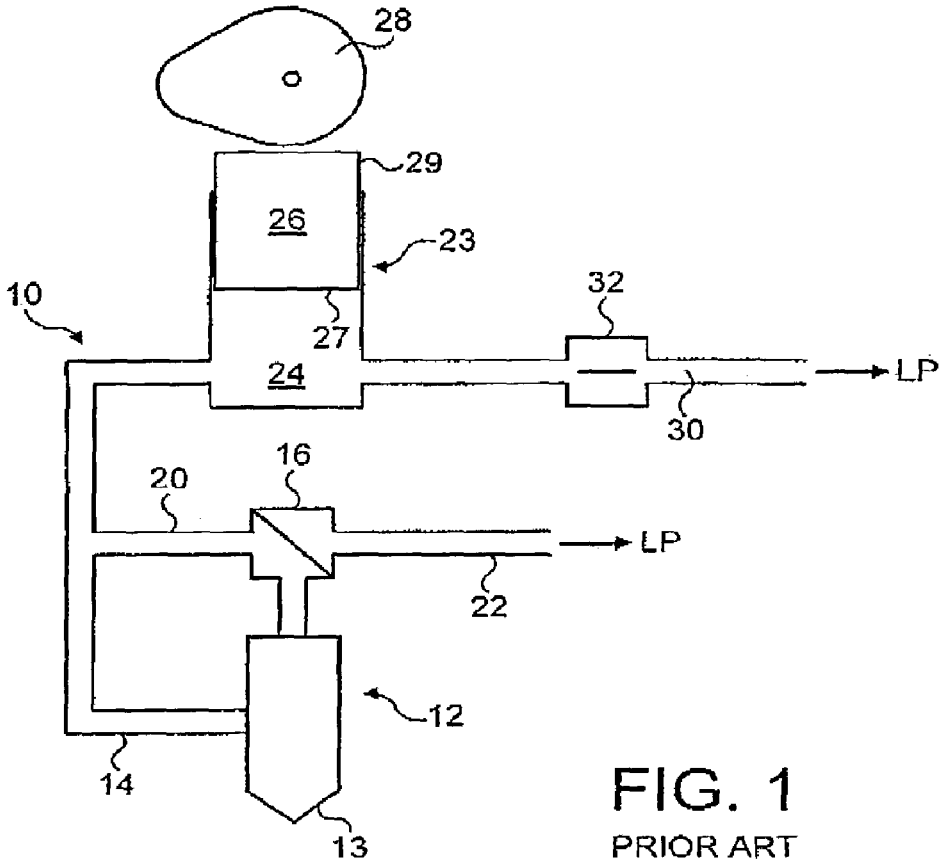
FIG. 1 PRIOR ART
FIG. 1 is a schematic diagram illustrating a known Electronic Unit Injector system.
Figure 2:
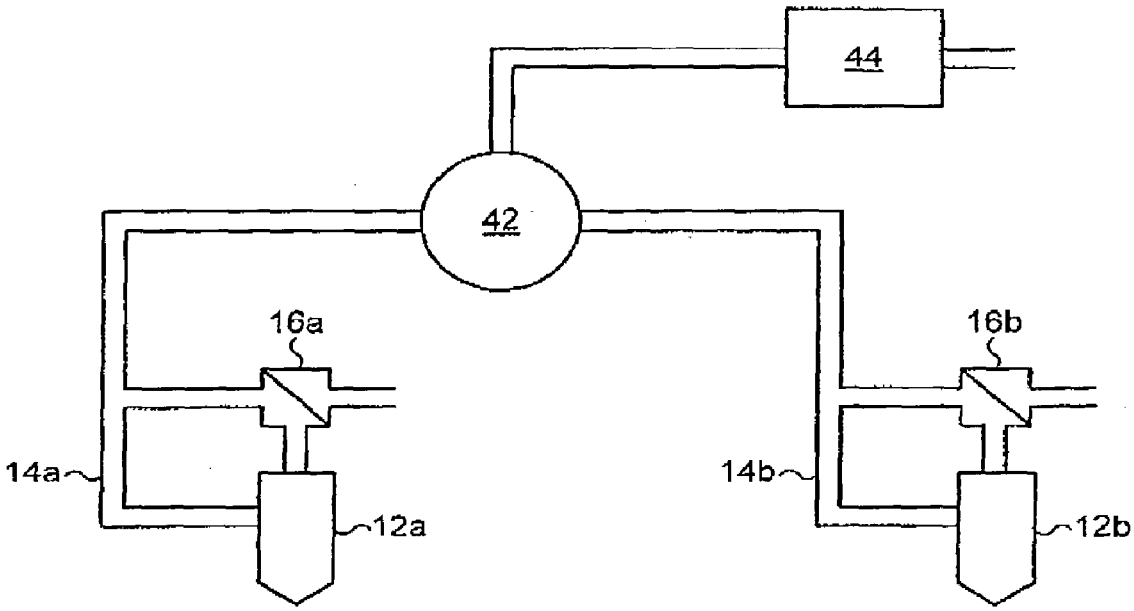
FIG. 2 PRIOR ART
FIG. 2 is a schematic diagram illustrating a known common rail fuel injection system.

By way of background to the present invention, FIGS. 1 and 2 show known Electronic Unit Injector (EUI) and common rail fuel systems respectively. Referring to FIG. 1, a known EUI arrangement 10 includes an injector 12 and a high pressure fuel line 14 for providing a supply of fuel at high pressure to an injection nozzle 13 of the injector 12. A control valve means, typically in the form of a nozzle control valve 16 (alternatively referred to as a needle control valve), is arranged to control movement of a fuel injector valve needle (not shown) so as to control the delivery of fuel from the injection nozzle 13. The valve needle is engageable with a valve needle seating and movement of the valve needle away from the seating permits fuel to flow through one or more outlets of the injection nozzle 13 into the associated engine cylinder or other combustion space.

The nozzle control valve 16 is arranged within a further passage 20 in communication with the supply line 14 to control communication between the high pressure supply line 14 and an injector control chamber (not shown). A surface of the valve needle is exposed to fuel pressure within the control chamber, and the pressure of fuel within the control chamber applies a force to the valve needle which serves to urge the valve needle against its seating.

The nozzle control valve 16 is movable between a first position and a second position. When the nozzle control valve 16 is in the first position, the further passage 20 communicates with the control chamber of the injector 12 and high fuel pressure within the chamber acts on the valve needle surface. When the nozzle control valve 16 is in the second position, the control chamber communicates with a low pressure reservoir (not shown) and communication between the further passage 20 and the control chamber is broken, and the pressure of fuel within the control chamber acting on the valve needle surface is reduced. Operation of the nozzle control valve 16 to control fuel pressure within the control chamber therefore provides a means of controlling valve needle movement towards and away from its seating.

The EUI 10 also includes a pump, referred to generally as 23, having a pumping element or plunger 26 and a pump chamber 24. The plunger 26 is movable within a plunger bore under the influence of a cam drive arrangement, including a cam 28, so as to pressurise fuel within the pump chamber 24. The pump chamber 24 communicates with the high pressure fuel line 14 and with a low pressure fuel reservoir (not shown), through an additional passage 30, under the control of a spill valve 32.

In use, rotation of a cam 28 serves to urge the plunger 26 inwardly within its bore to reduce the volume of pump chamber 24. When the spill valve 32 is in an open position, the pump chamber 24 communicates with the low pressure fuel reservoir so that the pressure in the pump chamber 24 is not substantially affected by movement of the plunger 26 and fuel is simply drawn into and displaced from the pump chamber 24 as the plunger 26 reciprocates. Closure of the spill valve 32 causes fuel pressure within the pump chamber 24 to rise as the plunger 26 is driven inwardly within its bore to reduce the volume of the pump chamber 24. During the stage of operation in which fuel within the pump chamber is at a high pressure level, the nozzle control valve 16 is then operated to commence injection.

FIG. 2 shows a known common rail fuel system including a plurality of fuel injectors 12*a*, 12*b* (two of which are shown), each having an associated nozzle control valve, 16*a*, 16*b* respectively and an associated high pressure fuel supply passages, 14*a*, 14*b* respectively, in communication with an accumulator volume in the form of a common rail 42. The common rail 42 is supplied with high pressure fuel from a common rail fuel pump 44 and provides an accumulated store of fuel for supply to all of the injectors of the fuel system. In use, the timing of injection of pressurised fuel by any one injector is controlled by actuation of its associated nozzle control valve 16*a*, 16*b*, in a similar manner as described above for the EUI 10.

Figure 3:
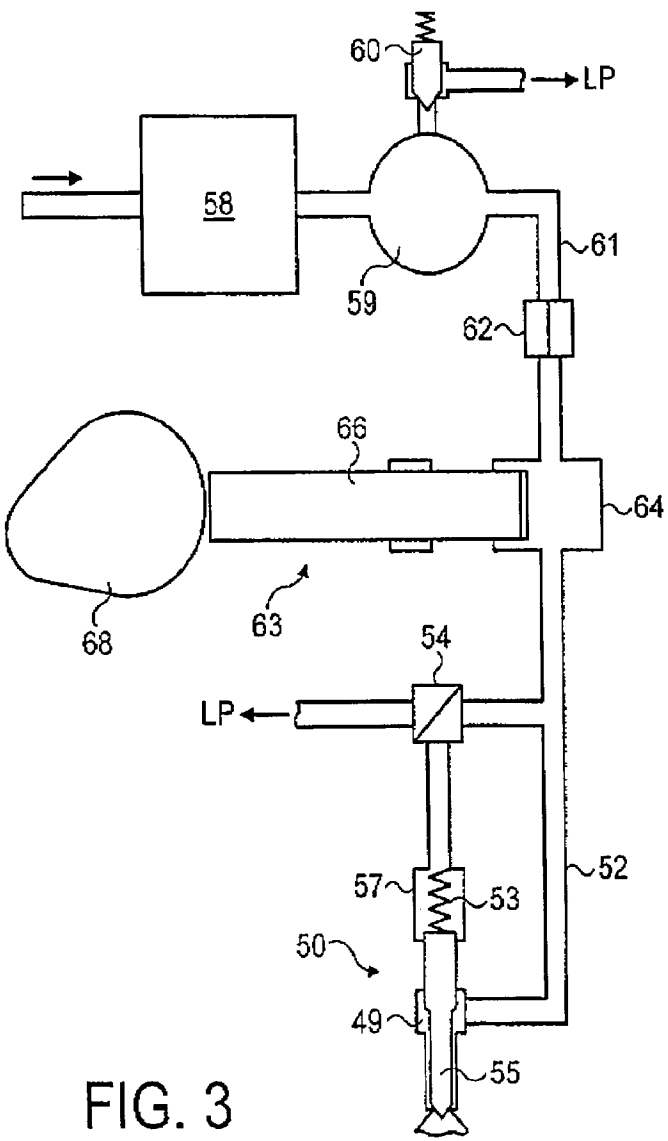
FIG. 3 is a schematic diagram of a first embodiment of a fuel injection system in accordance with one aspect of the present invention, and in which the system is in a first operating state.

The aforementioned limitations of EUI and common rail fuel systems, such as those shown in FIGS. 1 and 2, are addressed by the fuel injection system of the present invention. Referring to FIG. 3, there is shown a first embodiment of a fuel injection system in accordance with one aspect of the present invention. The fuel injection system includes an injector, referred to generally as 50, including an injection nozzle having a valve needle 55, the back end of which (the uppermost end in the illustration shown) is exposed to fuel pressure within a control chamber 57. An associated high pressure supply passage or line 52 delivers fuel to an injector delivery chamber 49. The injector 50 has an associated control valve, in the form of a nozzle or needle control valve 54. The nozzle control valve 54 is operable between a first position (herein referred to as a "closed" position) and a second position (herein referred to as an "open" position). When in the "closed" position, communication between the injector control chamber 57 and a low pressure reservoir is "closed" and the injector control chamber 57 communicates with the high pressure supply line 52. When in the "open" position, communication between the control chamber 57 and the low pressure reservoir is "open" and communication between the high pressure supply line 52 and the control chamber 57 is broken. A spring 53 is located in the control chamber 57 and serves to urge the valve needle towards a seated position in which it is engaged with a valve needle seating and no injection occurs.

It will be appreciated that it need not be a surface of the valve needle itself that is exposed to fuel pressure within the control chamber 57, but a surface associated with the valve needle, for example an extension of the valve needle, may be exposed to fuel pressure within the control chamber 57. Additionally, the chamber 57, and hence the valve needle spring 53, may be located remotely from the valve needle itself, whilst still providing the required closing force to seat the valve needle to termination of injection. A further design option is to locate the spring 53 elsewhere, and not within the control chamber 57. Further alternative variations in injector design will be apparent to those familiar with this technical field.

The fuel injection system also includes a common rail fuel pump 58 for supplying fuel at a moderately high and injectable pressure level (e.g. 300 bar) to an accumulator volume in the form of a common rail 59. It will be understood by the skilled reader that the phrase "common rail" is not limited to an accumulator volume of any particular shape or structure and may, for example, be of linear, spherical or other suitable configuration for storing high pressure fuel. A pressure regulator 60 is provided to maintain the pressure of fuel within the common rail 59 at a substantially constant level. For clarity, only one fuel injector 50 is shown in the system of FIG. 3, although in practice a plurality of injectors would be supplied with fuel from the common rail 59 in a multi-cylinder engine.

The common rail 59 supplies pressurised fuel to a supply passage or rail pressure line 61, in communication with a pump chamber 64, under the control of an electrically operable valve arrangement in the form of a rail control valve 62. The pump chamber 64 forms part of pump means or a pump arrangement 63 including a pumping plunger 66 that is driven by means of a cam drive arrangement including a driven cam 68. Each injector 50 of the system has a dedicated pumping arrangement 63, and thus has a dedicated pumping plunger 66 and cam 68. Conveniently, the injector 50 and its dedicated plunger 66 may be arranged within a common unit, in a so-called unit pump or unit injector arrangement. Typically, the cams 68 of each pump arrangement 63 are mounted upon a common shaft that is driven by the engine drive shaft. As the plunger 66 is driven, in use, it performs a pumping stroke, in which the plunger 66 is moved in a direction to reduce the volume of its associated pump chamber 64, and a return stroke, in which the plunger is moved in a direction to increase the volume of the pump chamber 64. The plunger 66 is typically provided with a plunger return spring (not illustrated) to effect the plunger return stroke.

The electrically operable rail control valve 62 is actuated in response to an electronic control signal provided by an associated engine controller to move the valve 62 between open and closed positions, and in this way the pressure of fuel that is supplied to the high pressure supply line 52 can be controlled. In FIG. 3, the fuel injection system is in a first operating state, in which the rail control valve 62 adopts its open position in which the common rail 59 communicates with the pump chamber 64. Under such circumstances, reciprocating movement of the plunger 66 has substantially no effect on fuel pressure within the chamber 64. Thus, with the rail control valve 62 in the open position, the pressure of fuel supplied through the high pressure supply line 52 to the injector 50 is determined by the pressure of fuel within the common rail 59, which, typically, will be around 300 bar. The nozzle control valve 54 is in a closed state, in which communication between the control chamber 57 and the low pressure reservoir is closed and the control chamber 57 communicates with the high pressure supply line 52. Thus there is a high force acting on the back end of the valve needle 55 due to high pressure fuel within the control chamber 57, and this force aids the force due to the spring 53 in ensuring the valve needle 55 is seated to prevent fuel injection.

Figure 4:
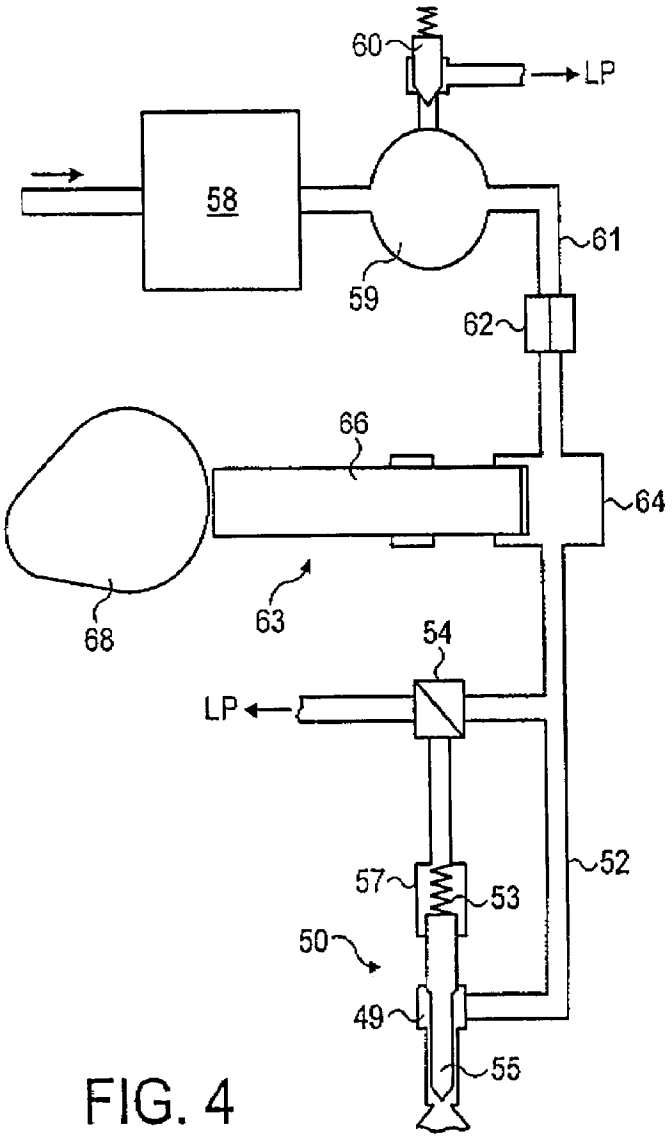
FIG. 4 shows the fuel injection system in FIG. 3 when in a second operating state.

Referring to FIG. 4, in order to inject fuel at a first, moderate pressure level (P1), determined by the pressure of fuel within the rail 59, the nozzle control valve 54 is actuated to move into an open position in which communication between the control chamber 57 and the low pressure reservoir is opened, thereby causing fuel pressure within the control chamber 57 to be reduced. The valve needle is caused to lift away from its seating due to a force acting on one or more valve needle thrust surfaces by high pressure fuel delivered to the injector 50. During this first injecting state, fuel is injected into the engine at a first pressure level (P1) that is referred to as a "moderate" pressure level but is nonetheless sufficiently high to be an injectable pressure level for combustion.

Figure 5:
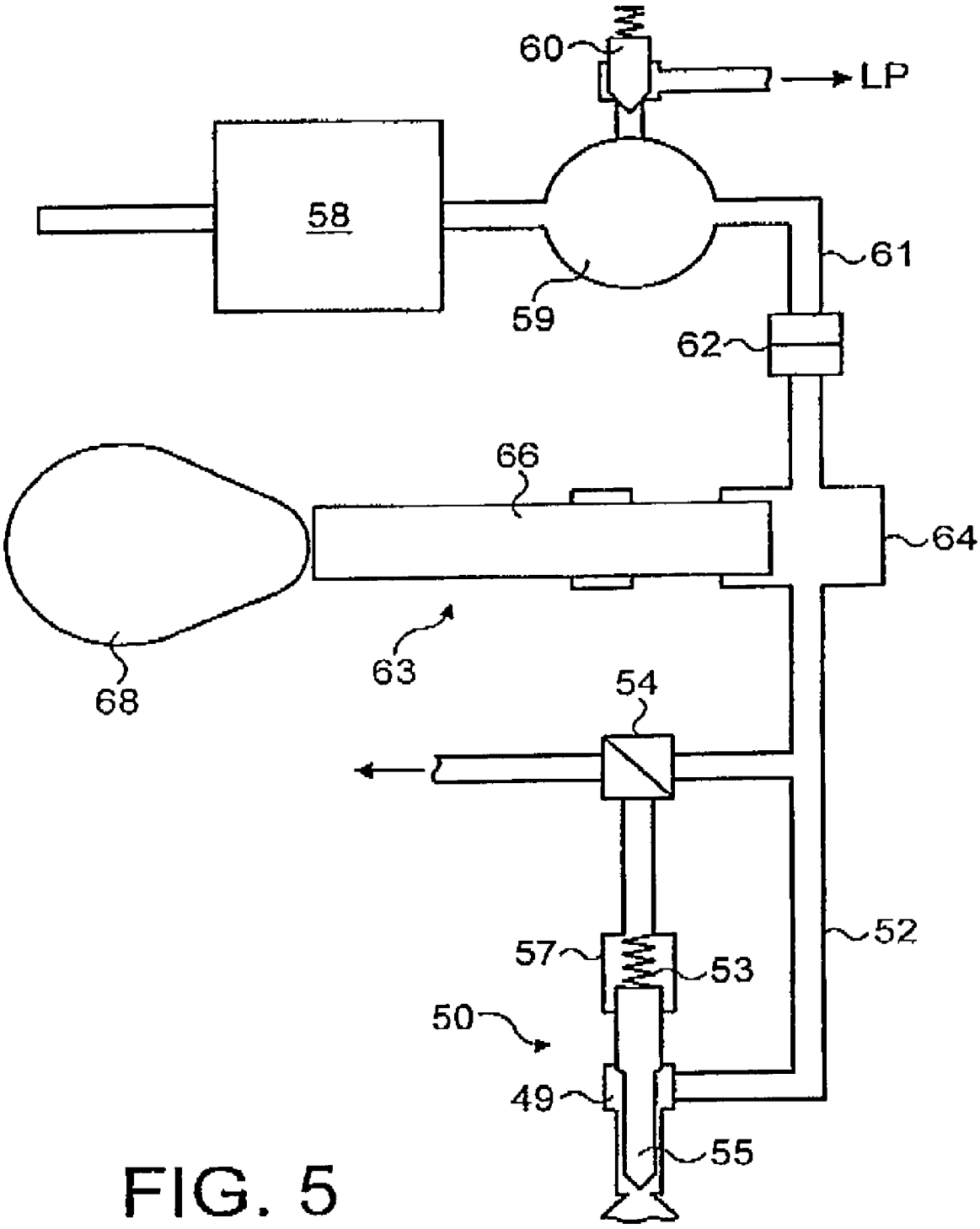
FIG. 5 shows the fuel injection system in FIGS. 3 and 4 when in a third operating state.

FIG. 5 shows the fuel injection system in FIGS. 3 and 4 when in a second operating state in which the rail control valve 62 has been moved into its closed position to break communication between the rail pressure line 61 from the common rail 59 and the pump chamber 64. With the rail control valve 62 in its closed position, reciprocal movement of the plunger 66 under the influence of the cam 68 enables fuel pressure within the pump chamber 64 to be increased to a second injectable pressure level (P2), which is greater than the first pressure level (P1). Typically, the second pressure level is between 2000 and 2500 bar. With the rail control valve 62 closed and with fuel pressure in the pump chamber 64 at the second injectable pressure level, the nozzle control valve 54 can then be actuated to move into its open position in which the injector control chamber 57 is brought into communication with the low pressure reservoir. By moving the nozzle control valve 54 into its open position, the valve needle is caused to lift from its seating, as described previously, to permit injection at this second, higher pressure level, P2.

The timing of injection of fuel at the first, moderate pressure level, P1, is therefore controlled by operation of the nozzle control valve 54 while the rail control valve 62 is open and the timing of injection of fuel at the second, higher pressure level is controlled by operation of the nozzle control valve 54 while the rail control valve 62 is closed, and in which circumstances the pump arrangement 63 serves to increase the pressure of fuel supplied by the common rail 59 to the second higher pressure level, P2. For both the first and second operating pressures, P1, P2, the timing at which injection is terminated is controlled by moving the nozzle control valve 54 to its closed position so as to close communication between the control chamber 57 and the low pressure reservoir, thereby re-establishing high fuel pressure in the injector control chamber 57 and causing the valve needle to seat.

In an alternative mode of operation, injection at the second, higher pressure level can be terminated by moving the nozzle control valve 54 into its open position and, at about the same time, opening the rail control valve 62. By opening the rail control valve 62 at the same time as the nozzle control valve 54 is opened, closure of the valve needle is aided due to communication between the pump chamber 64 and the common rail 59 causing a reduction in pressure within the high pressure supply line 52 and the injector 50 (i.e. pressure is reduced to the first pressure level, P1).

From the foregoing description it will be appreciated that the system has two distinct modes of operation, one in which the system operates in a common rail-type mode in which fuel at the first, moderate rail pressure is delivered to the injector 50 and one in which the system operates in an EUI-type mode in which fuel at a second, higher level is delivered to the injector 50. By varying the operating mode between the first and second, it will be appreciated that a range of different injection characteristics can be achieved. Typically, for example the main injection of fuel in an injection cycle may be provided by operating in EUI-type mode (higher pressure level), and non-main injections of fuel, such as pilot or post injections of fuel or injections for after-treatment purposes, may be provided by operating in common rail-type mode (moderate pressure level).

It is a particular advantage of the fuel injection system in FIGS. 3 to 5 that an injection event comprising a pilot injection of fuel at a first, moderate pressure level followed by a main injection event at a second, higher pressure level can be achieved. It has been found that this combination of a pilot followed by a main injection of fuel provides a benefit for emissions levels and noise.

To illustrate the injection characteristic of the fuel injection system in FIGS. 3 to 5, FIGS. 6 shows an example of the injection rate R of fuel as a function of time T, for an injection event including a pilot injection of fuel followed by a main injection of fuel. It will be appreciated that the injection rate for any given injection nozzle will depend upon the actual pressure of fuel that is supplied to the nozzle.

Figure 6:
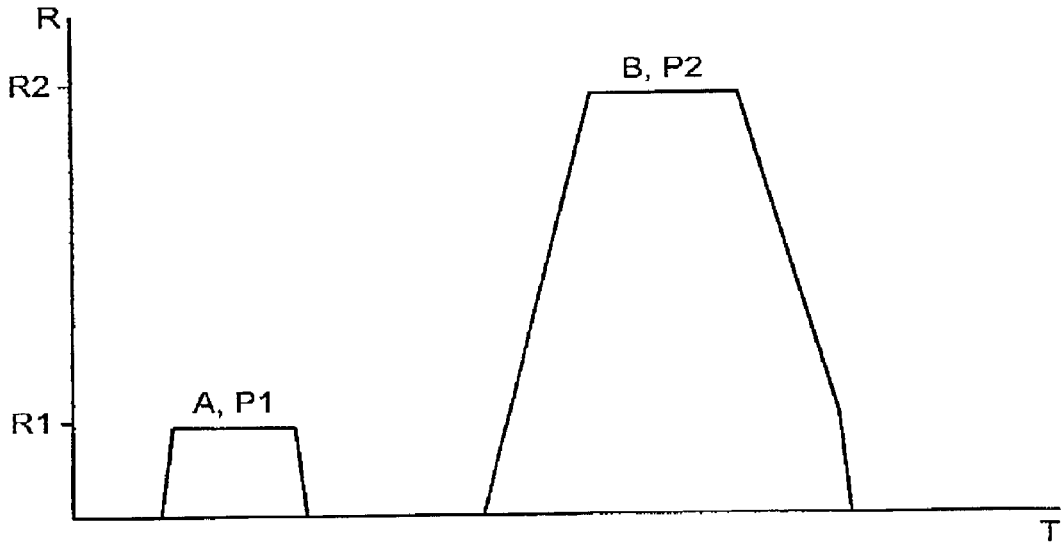
FIG. 6 is a graph showing a fuel injection characteristic that is obtainable using the fuel injection system in FIGS. 3 to 5.

Referring to FIG. 6, the initial pilot injection of fuel, A, at a rate R1 is achieved by injecting fuel at moderate rail pressure, P1, for a relatively short duration of time. A main injection of fuel, B, follows at a higher rate R2 and at pressure level P2. For the pilot injection of fuel, the injection rate R1 is achieved by moving the rail control valve 62 into its open position and maintaining the rail control valve 62 in this position whilst the nozzle control valve 54 is moved into its open position to cause the injector valve needle 55 to lift. The pilot injection of fuel is terminated by closing the nozzle control valve 54 to re-establish high pressure fuel within the control chamber 57, thereby causing the valve needle 55 to seat.

Injection at the second, higher pressure level, P2, is generated by closing the rail control valve 62 such that the pump arrangement 63 causes fuel pressure within the pump chamber 64 to be increased to a level higher than that within the common rail 59. The nozzle control valve 54 is opened to commence the main injection of fuel, B, at this second pressure level, P2 and is closed to terminate the main injection, as described previously.

As mentioned previously, the rail control valve 62 can also be closed at about the same time as the nozzle control valve 54 is opened to aid a rapid termination of injection at the second pressure level, P2.

Figure 7:
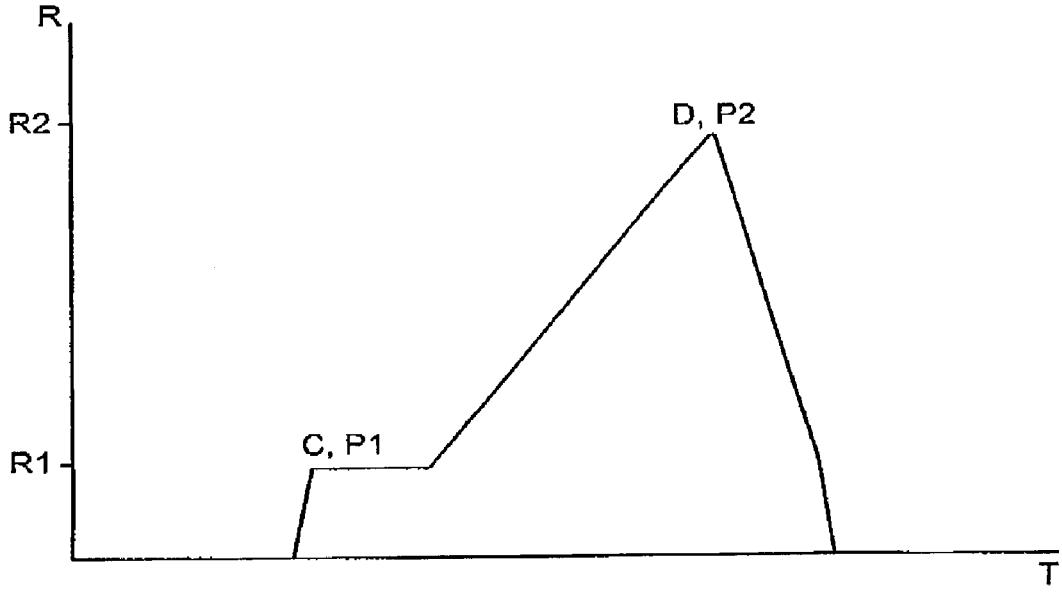
FIG. 7 is another graph showing an alternative fuel injection characteristic which is obtainable using the fuel injection system of FIGS. 3 to 5.

It has also been found that a main injection of fuel having a so-called "boot-shaped" injection characteristic, as shown in FIG. 7, provides particular benefits for emissions levels. A boot-shaped main injection includes an initial injection of fuel, C, at a first rate R1 (rail pressure P1) followed immediately by an injection of fuel at a higher rate, R2 (pump chamber pressure, P2) and is achieved by moving the rail control valve 62 between its open position (rail pressure P1) and its closed position (increased pressure P2) whilst the nozzle control valve 54 is held in its open position so as to maintain the valve needle in its lifted position.

It will be appreciated that the pressure levels P1, P2 and the injection rates R1, R2 are arbitrary, and need not represent the same pressure levels and injection rates in both FIG. 6 and FIG. 7.

Figure 8:
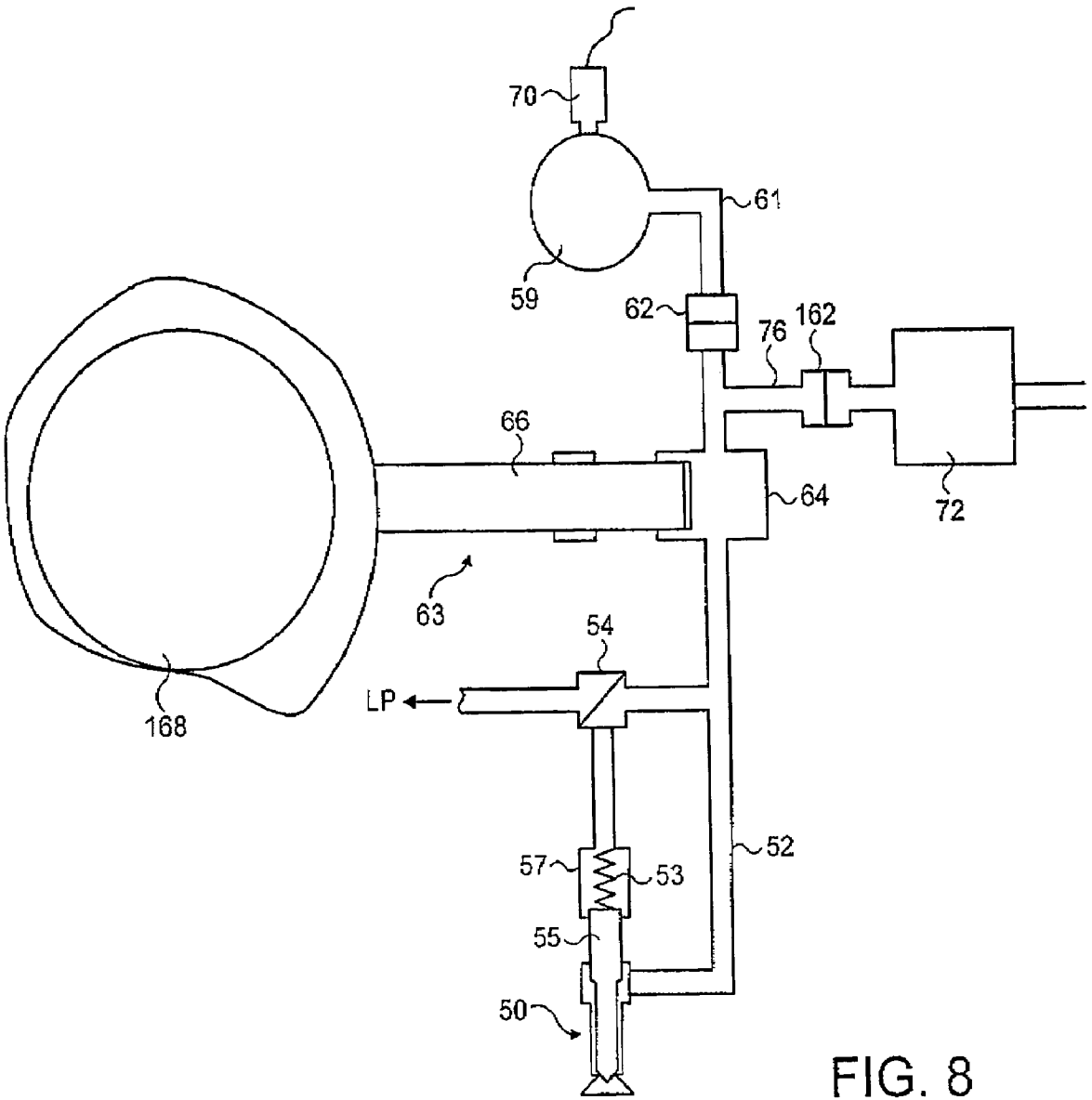
FIG. 8 is schematic diagram to illustrate an alternative embodiment of the fuel injection system to that shown in FIGS. 3 to 5.

In a variation to the fuel injection shown in FIGS. 3 to 5, the common rail fuel pump 54 for supplying fuel to the common rail 59 may be removed, and instead the pump arrangement 63 itself may be used to charge the common rail 59 to a first, injectable pressure level. FIG. 8 is an alternative embodiment in which no common rail fuel pump is provided. Similar components to those shown in FIGS. 3 to 5 are identified with like reference numerals and will not be described in further detail.

Referring to FIG. 8, the common rail 59 is provided with a rail pressure sensor 70 for monitoring the pressure of fuel within the rail 59 and for providing an output signal that is a measure of fuel pressure within the rail 59. A low pressure pump 72 is provided for supplying fuel to the pump chamber 64 under the control of an electrically actuable control valve 162, or "fill/spill" valve, that is operable between open and closed positions. When the fill/spill valve 162 is in the open position the low pressure pump 72 supplies fuel to the pump chamber 64 at a relatively low pressure, P3, through a supply passage 76. When the fill/spill valve 162 is in a closed position the supply of fuel to the pump chamber 64 by the pump 72 is prevented. Typically, the low pressure pump 72 may take the form of a transfer pump that is arranged to supply fuel at a pressure level dependent upon engine speed (referred to as "transfer pressure").

In use, the fill/spill valve 162 is moved into its open state during the plunger return stroke so that fuel is supplied from the transfer pump 72 to the pumping chamber 64 through the supply passage 76. As the plunger 66 is driven by the cam during the pumping stroke, the fill/spill valve 162 is closed and the pressure of fuel within the pump chamber 64 is increased to a level that is higher than transfer pressure, but typically less than the pressure that would be achieved by a high pressure common rail-type pump. If during this time the rail control valve 62 is held in its open position, fuel at the first injectable pressure level is supplied to the common rail 59. Fuel at this first injectable pressure level is also supplied to the high pressure supply line 52. Typically, the pressure of fuel within the pumping chamber 64 during this operating state is at a moderate pressure level of between 300 and 1000 bar.

If, with the fill/spill valve 162 closed, the rail control valve 62 is also closed, the pressure of fuel within the pumping chamber 64 will be increased during the pumping stroke of the plunger 66 to a second pressure level that is higher than the first. Typically, this second injectable pressure level may be between 2000 and 3000 bar.

During both the first and second modes of operation, commencement of injection is controlled by actuating the nozzle control valve 54 to move into its open position so that fuel in the control chamber 57 is able to flow to low pressure, so allowing the valve needle 55 to open. Injection may be terminated by actuating the nozzle control valve 54 to move into its closed position so that high fuel pressure is re-established within the control chamber 57.

Again, it can therefore be considered that the fuel injection system of FIG. 8 has two distinct modes of operation. In a first mode of operation, the system operates in a common rail-type mode in which plunger movement has minimal or no effect on the pressure level in the pumping chamber 64 due to the rail control valve 62 being open, and fuel at the first, moderate rail pressure (P1) is delivered to the injector 50. In a second mode of operation the system operates in an EUI-type mode in which plunger movement increases the pressure level to a second higher level (P2), due to the rail control valve 62 being closed, and fuel at this higher level is delivered to the injector 50.

It will be appreciated that the relative timing of operation of the rail control valve 62 and of the fill/spill valve 162 is important, so as to ensure that fuel is pressurised within the pump chamber 64 during the pumping stroke and is not simply returned to the transfer pump 72 through an "open" fill/spill valve and also to ensure that pressurisation to the second pressure level occurs at the required time (i.e. by closing the rail control valve 62). In practice, for example, the time for which the valves 162, 62 are open, and the relative timing of their opening and closure, will be controlled by control signals provided by the engine controller in accordance with look-up tables or data maps containing pre-stored information. The implementation of look-up tables and data maps for engine fuelling purposes would be familiar to a person skilled in this technical field.

An alternative to operating the nozzle control valve 54 to terminate injection, with the system of FIG. 8 it is possible to terminate injection by relieving high fuel pressure within the supply line 52 through operation of the fill/spill valve 162. Termination of injection in this manner may be referred to as "spill-type" end of injection, or "spill-end" of injection. If during the pumping stroke of the plunger 66, and with the valve needle 55 lifted so that injection is occurring, the fill/spill valve 162 is moved into its open position, fuel within the pumping chamber 64 is caused to flow back through the passage 76 to the transfer pump 72 so that the pressure of fuel in the supply line 52 to the injector 50 is reduced. In such circumstances, the opening force on the valve needle due to fuel pressure delivered through the high pressure supply line 52 to the delivery chamber 49 is reduced which, in combination with the force due to the spring 53, will cause the valve needle to be seated to terminate injection. Termination of injection can therefore be achieved, even if the nozzle control valve 54 remains in its open position. It has been found that terminating injection in this way may benefit the fuel spray formation, and thus may benefit emissions levels, as there is no requirement to force the valve needle 55 to close against the high hydraulic force acting in the opening direction due to pressurised fuel in the supply line 52.

As a further alternative method of terminating injection, the nozzle control valve 54 may be actuated at or about the same time as the fill/spill valve 162 is opened, so that reduced fuel pressure within the high pressure supply line 52 by virtue of the open fill/spill valve 162 is complemented by the opening of communication between the control chamber 57 at the back of the valve needle 55 and the low pressure reservoir. Termination of injection in this way is therefore a combination of spill-end injection and nozzle control valve actuation.

It is a further feature of the fuel injection system in FIG. 8 that if it is desirable to reduce the pressure of fuel that is stored within the common rail 59, this can be achieved by actuating the rail control valve 62 to open when the fill/spill valve 162 is open, thereby permitting pressurised fuel within the rail 59 to flow to the transfer pump 72. The output signal 70 provided by the pressure sensor 70 is supplied to the engine controller, which in turn supplies the control signals to the rail control valve 62 and the fill/spill valve 162 so as to cause them to open when it is required to relieve fuel pressure within the rail.

Another difference between the embodiment shown in FIGS. 3 to 5 and that in FIG. 8 is that in FIG. 8 the pumping plunger 66 is driven by a cam arrangement having a cam 168 with an "irregular" cam surface. The cam 168 is shaped such that the return stroke of the plunger 66 is "interrupted" and therefore includes a number of discrete steps of plunger movement. Each of the cams 168 of the system is shaped in a similar manner, and the cams that are mounted upon a common cam shaft are oriented relative to one another so that each step of plunger movement through the return stroke of one plunger is substantially synchronous with a pumping stroke of one of the other plungers of the system.

Typically, each cam surface is shaped to include a rising flank, and the remainder of the cam surface includes a surface irregularity which serves to define an interval of interruption in the return stroke of the associated plunger between or separating adjacent steps of return stroke movement. In one preferred configuration, each cam surface is shaped to define a number of steps of movement through the associated return stroke that is equal to the number of other plungers for which the associated cams share a common drive shift. Alternatively, however, the number of steps in the return stroke may be one less than the number of other plungers in the pump.

A more detailed description of a cam arrangement of this type is given in our co-pending British patent application, GB0229487.2, the full contents of which are incorporated herein by reference. One benefit of using a cam arrangement in which the cams are shaped and configured to provide phased, stepped return stroke movement is that reversal of torque loading on the cam shaft (i.e. the variation between positive and negative torque loading) is reduced. The peak torque loading on the cam shaft is also reduced. Furthermore, as the total hydraulic volume of the pumping chambers 64 of the system is maintained at a reasonably constant level at all stages of operation, fluctuations of the high pressure level within this total volume are limited and, hence, the total volume can be made smaller.

As an alternative to providing each plunger with a cam that is shaped to provide stepped return stroke movement, a cam having two or more lobes may be used to drive each plunger. Using a twin-lobed cam, for example, one cam lobe may be used to provide a first pumping stroke of the plunger 66 for pressurising fuel within the pump chamber 64 to the second injectable pressure level P2 during the EUI-type mode of operation (rail control valve 62 closed), and the second lobe of the cam may be used to provide a second pumping stroke of the plunger 66 for pressurising fuel within the pump chamber 64 to the first injectable pressure level, P1, during the common rail-type mode of operation of the system (rail control valve 62 open). For a part of the first pumping stroke of the plunger effected by the first cam lobe, pressurisation to the second pressure level P2 occurs by closing the rail control valve 62 and pressurisation to the first pressure level to supplement rail pressure is also possible for the first pumping stroke by opening the rail control valve 62 part way through the stroke. It will be appreciated that the part of the first pumping stroke that is used to supplement pressurisation to the first pressure level occurs outside the period for which injection at the second pressure level occurs.

Figure 9:
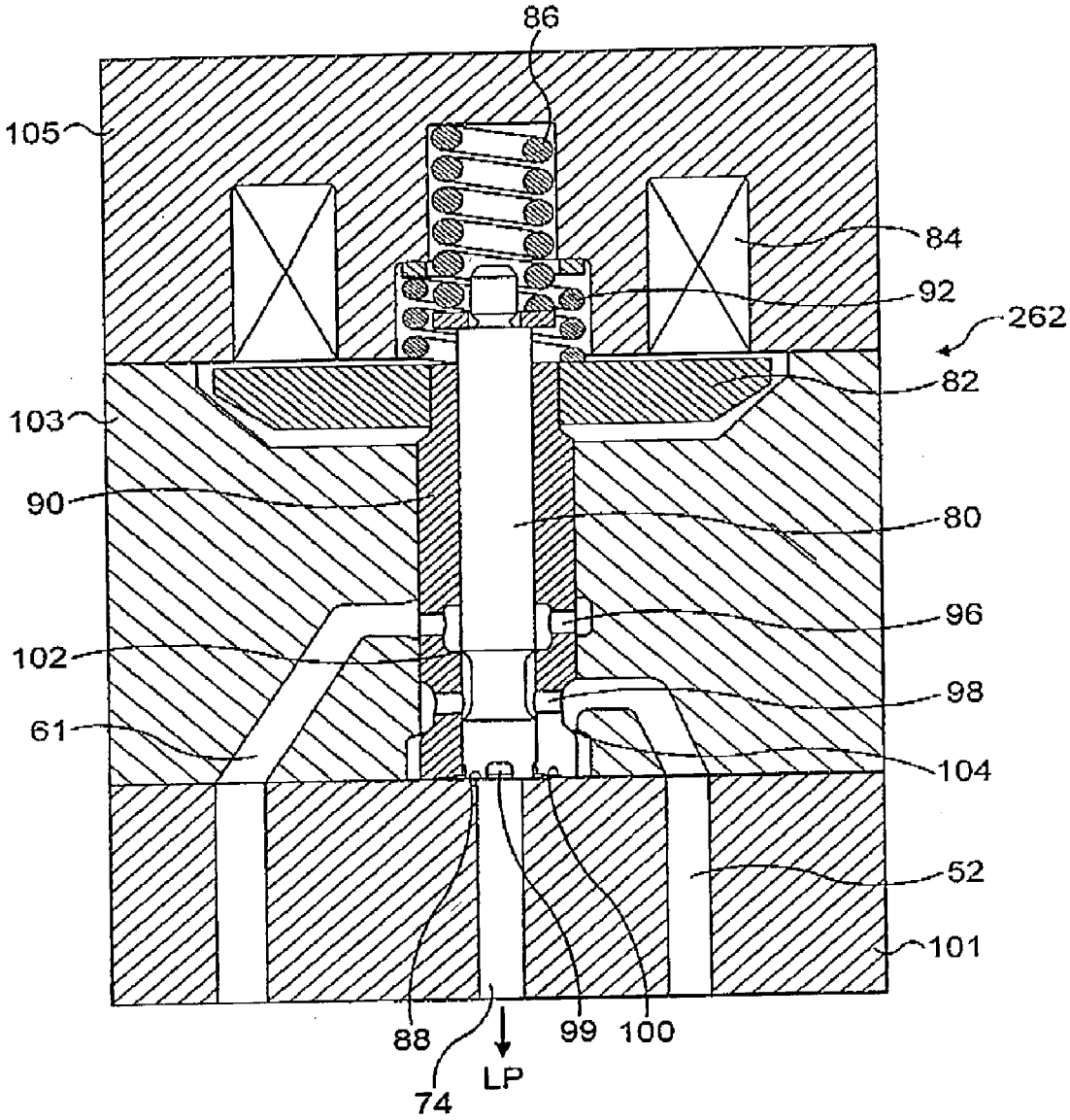
FIG. 9 is a sectional view of a three position valve for use in a further alternative embodiment of the fuel injection system.
Figure 10:
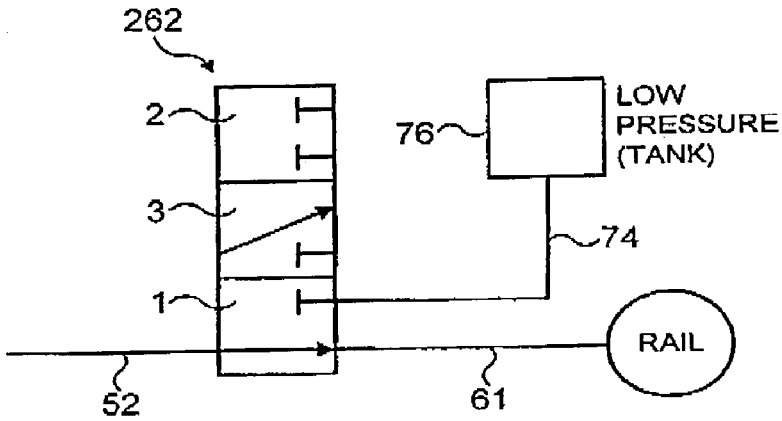
FIG. 10 is a schematic view of the valve in FIG. 9 to show its three operating positions.
Figure 11:
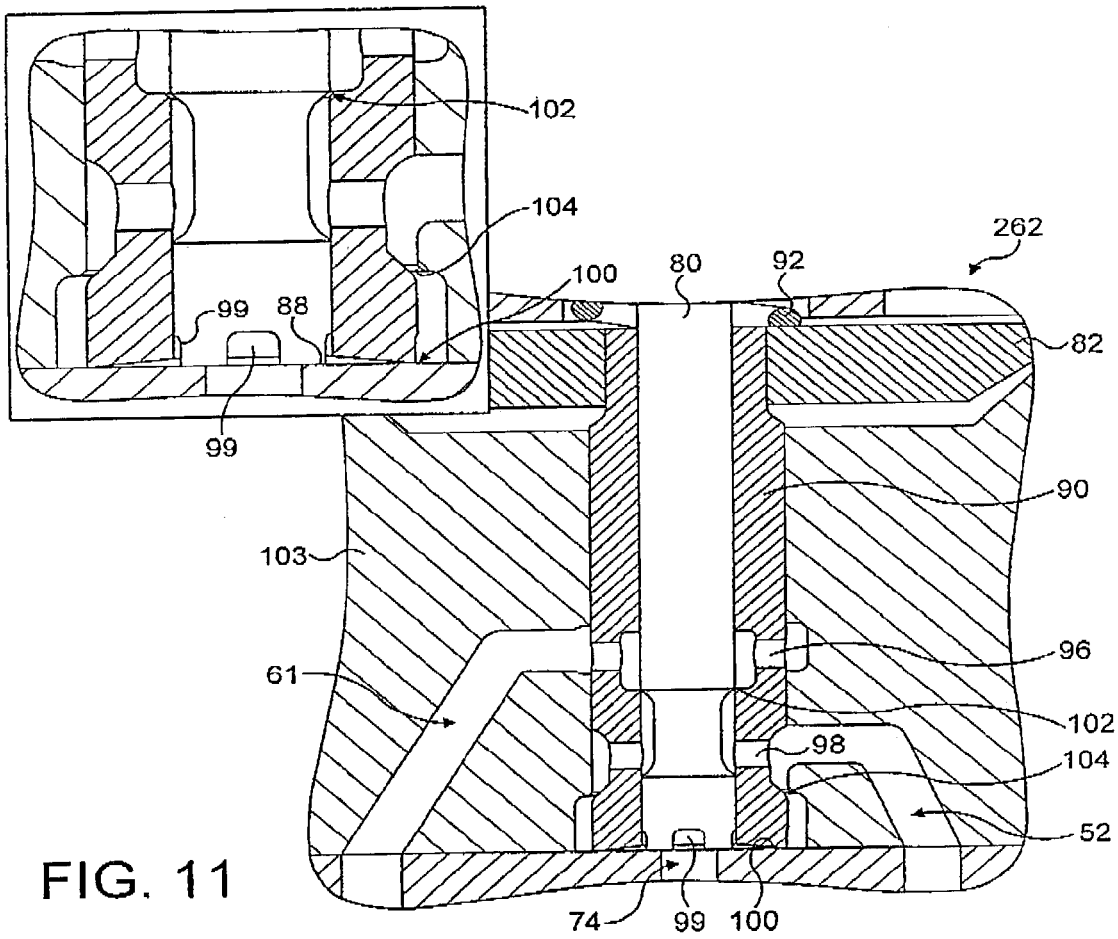
FIG. 11 is an enlarged sectional view of the three-position valve in FIGS. 9 and 10, with an insert showing seatings of the valve in enlarged detail.

In a further alternative embodiment of the fuel injection system in FIGS. 3 to 5 and 8, a valve having three different operating positions may be provided to control the level of fuel pressure that is supplied to the injector 50 through the supply line 52. Referring to FIGS. 9, 10 and 11, a three-position valve, referred to generally as 262, may be included in the fuel injection system. The three-position valve 262 may be included in the system of FIGS. 3 to 5, in place of the two-position rail control valve 62, or may be included in the system of FIG. 8 in place of the rail control valve 62 and the fill/spill valve 162.

The following description assumes the three-position valve 262 is included in the system of FIGS. 3 to 5, in place of the rail control valve 62, with like reference numbers being used to denote similar parts. The three-position valve 262 is operable between a first position 1 (as in FIG. 10) in which the rail pressure line 61 communicates with the high pressure supply line 52 to the injector 50 (common rail-type mode), a second position 2 in which the high pressure supply line 52 communicates with a low pressure reservoir 76 through a return line 74, and a third position 3 in which communication between the return line 74 the high pressure line 52 is broken and in which communication between the rail pressure line 61 and the high pressure supply line 52 is broken (EUI-type mode).

The three-position valve includes an inner valve member 80 and an outer valve member 90 that is coupled to an armature 82 of an electromagnetic actuator that also includes an electromagnetic winding 84. The three-position valve includes spring means in the form of an inner valve spring 86 that is arranged to urge the inner valve member 80 into a position in which it engages a stop surface 88. The inner valve member 80 extends through and is slideable within a through bore of the outer valve member 90, and is provided with a plurality of cut-away regions at its end adjacent to the stop surface 88 to define a flow path 99 for fuel into the return line 74. The outer valve member 90 is provided with first and second cross drillings 96, 98 respectively that define flow paths for fuel in dependence upon the position of the valve 262, as described further below.

The valve 262 is comprised of first, second and third housing parts 101, 103 and 105 respectively. A surface of the first housing part 101 defines the stop surface 88 for the inner valve member 80 and a first valve seating 100 for the outer valve member 90. The spring means of the three-position valve 262 also includes an outer valve return spring 92 associated with outer valve member 90 that serves to urge the outer valve member 90 into engagement with the first seating 100. A second valve seating 102 for the outer valve member 90 is defined by the inner valve member 80, and a third valve seating for the outer valve member is defined by a surface of a bore in the housing 103.

The outer valve member 90 is engageable with the first and third valve seatings 100, 104 to control fuel flow between the high pressure line 52 and the return line 74, and is engageable with the second valve seating 102 to control fuel flow between the high pressure fuel line 52 and the rail pressure line 61 and whether movement of the outer valve member 90 is coupled to the inner valve member 80 when the outer valve member 90 is caused to lift away from the first valve seating 100.

The outer valve member 90 is urged into engagement with the first valve seating 100 by means of the outer valve spring 92, and in which position the outer valve member 90 is spaced from the second valve seating 102. With the winding 84 de-energised the outer valve member 90 is engaged with the first seating 100, but spaced from the second seating 102, and the inner valve member 80 is engaged with the stop surface 88. This is the first operating position 1 of the valve 262 (as shown in FIG. 10) in which the rail pressure line 61 is in communication with the high pressure line 52 to the injector 50 by virtue of the cross drillings 96, 98 in the outer valve member 90.

If the nozzle control valve 54 is actuated when the valve 262 is in this first valve position, the pressure of fuel injected to the engine is therefore at the first, moderate rail pressure, P1, as described previously.

Upon partial energisation of the winding 84 to a first energisation level, the force applied to the armature 82 causes the outer valve member 90 to move against the force of the outer valve return spring 92, so that the outer valve member 90 moves away from the first valve seating 100 and an outer surface of the outer valve member 90 is brought into engagement with the second seating 102 defined by the inner valve member 80. The force due to the inner valve return spring 86 is large enough to ensure the inner valve member 80 remains seated against the stop surface 88. Communication between the rail pressure line 61 and the high pressure supply line 52 is therefore broken as fuel is no longer able to flow past the second seating surface 102.

As the outer valve member 90 has been moved away from the first valve seating 100, however, the high pressure line 52 is brought into communication with the return line 74 through the flow path 99 defined at the end of the inner valve member 80. This operating condition of the valve 262 is referred to as "the third valve position", as shown in FIG. 10. It will be appreciated that the seatings 102, 104 are arranged and positioned such that in this third valve position the outer valve member 90 remains spaced from the third seating 104 to ensure fuel within the high pressure line 52 is able to flow to the return line 74.

When the winding is energised to a higher energisation level, there is sufficient force on the armature 82 to overcome the force due to the inner valve return spring 86. This causes further movement of the outer valve member 90 away from the first seating surface 100 and additionally causes movement of the outer valve member 90 to be coupled to the inner valve member 80 by virtue of engagement between the outer valve member and the second seating 102. The coupling of the outer valve member 90 to the inner valve member 80 causes the inner valve member 80 to be lifted away from the stop surface 88. The outer valve member 90 is brought into engagement with the third seating 104. This shall be referred to as the second valve position, in which position fuel is unable to flow past the third seating 104 so that communication between the high pressure supply line 52 and the return line 74 is broken. Communication between the rail pressure line 61 and the high pressure supply line 52 remains broken due to the valves 80, 90 being engaged at the second seating 102, and so it is in this position (position 2) that pumping by the plunger 66 results in the second, higher pressure level (P2) being achieved in the pump chamber 64.

It will be appreciated that the three-position valve 262 in FIGS. 9 to 11 provides a means of operating the fuel injection system in the same manner as described with reference to FIGS. 3 to 5. In addition, however, because communication between the high pressure supply line 52 and the return line 74 can be opened with the valve 262 in the third operating position, whilst maintaining pressure in the rail pressure line 61 (and hence the common rail 59) at the moderate, rail pressure, it is also possible to terminate injection using a spill-end type of injection. By moving the valve 262 into its third operating position, pressure of fuel in the high pressure supply line 52 is reduced and the valve needle 55 is caused to close under the force of the spring 53. Termination of injection can therefore be implemented without operating the nozzle control valve 54, if desired. It has been found that this may provide an improved fuel spray formation at the end of injection.

In addition to moving the three-position valve 262 into its third position to terminate injection, the nozzle control valve 54 may also be operated at the same time so as to achieve a more rapid end to injection, if desired.

The three-position valve show in FIGS. 9 to 11 is one example of a valve structure for achieving the three desired operating positions 1, 2 and 3, but other valve structures for achieving this are also envisaged. For example, in an alternative embodiment the inner valve 80 may be coupled to the armature 82, with the outer valve member 90 being coupled to move with the inner valve member 80 under partial energisation conditions. A separate European patent application, filed concurrently with the present application, describes other possible configurations for a three-position valve 262 of this type in further detail.

A further alternative embodiment to those shown described previously is shown in FIG. 12. Similar parts to those shown in FIG. 8 are identified with like reference numerals and will not be described in further detail. In this embodiment, the rail control valve 62 is provided, as before, to control whether the pump chamber 64 communicates with the common rail 59. In addition, a non return valve 362 is provided, having a non return spring 364, to control communication between the transfer pump 72 and the pump chamber 64. The non return valve 362 is hydraulically operable in dependence upon the fuel pressure difference across it. During the return stroke of the plunger 66 when fuel pressure in the pump chamber 64 is decreasing, the pressure of fuel supplied by the transfer pump 72 is sufficient to overcome the force of the non return spring 364 so that the non-return valve 362 is opened and fuel is supplied from the transfer pump 72 to the pump chamber 64. As the pumping plunger 66 is driven to perform its pumping stroke, the pressure of fuel in the pump chamber 64 will be increased and the non-return valve 362 is caused to close and continued pumping causes the pressure of fuel within the pump chamber 64 to increase further.

As described previously, if the rail control valve 62 is in its open state the pressure of fuel within the pump chamber 64 is pressurised to a first, moderate rail pressure, but if the rail control valve 62 is closed fuel pressure within the pumping chamber 64 will be increased to the second, higher level.

In order to inject fuel at the first, moderate rail pressure level, P1, the rail control valve 62 is opened so that the pump chamber 64 communicates with the common rail 59. In order to inject fuel at the second, higher pressure level, P2, the rail control valve 62 is closed, so that communication between the pump chamber 64 and the common rail 59 is broken.

The combination of the rail control valve 62 and the non return valve 362 in the embodiment of FIG. 12 therefore provides a similar function to the rail control valve 62 and the fill/spill 162 in FIG. 8, and to the three-position valve described with reference to FIGS. 9 to 11. However, the fill/spill valve 162 in the FIG. 8 embodiment and the three-position valve 262 in the embodiment of FIGS. 9 to 11 provide an additional degree of control in that their use permits rail pressure to be spilled back to the transfer pump 72. Simply incorporating the non return valve 362 and the rail control valve 62 in place of the rail control valve 62 and the fill/spill valve 162 in FIG. 9, or in place of the three-position valve of FIGS. 9 to 11, does not, however, provide an option to spill-end injection. As mentioned previously, it has been recognised that terminating injection using a spill end technique can be advantageous, as terminating injection by forcing the valve needle 55 to close against a high force due to pressurised fuel within the injection nozzle can result in an undesirable fuel spray formation. For this reason, in systems for which the combination of the rail control valve 62 and the non-return valve 362 is preferred (as in FIG. 12), it is desirable to include an additional high pressure shut off valve arrangement in the system.

Figure 12:
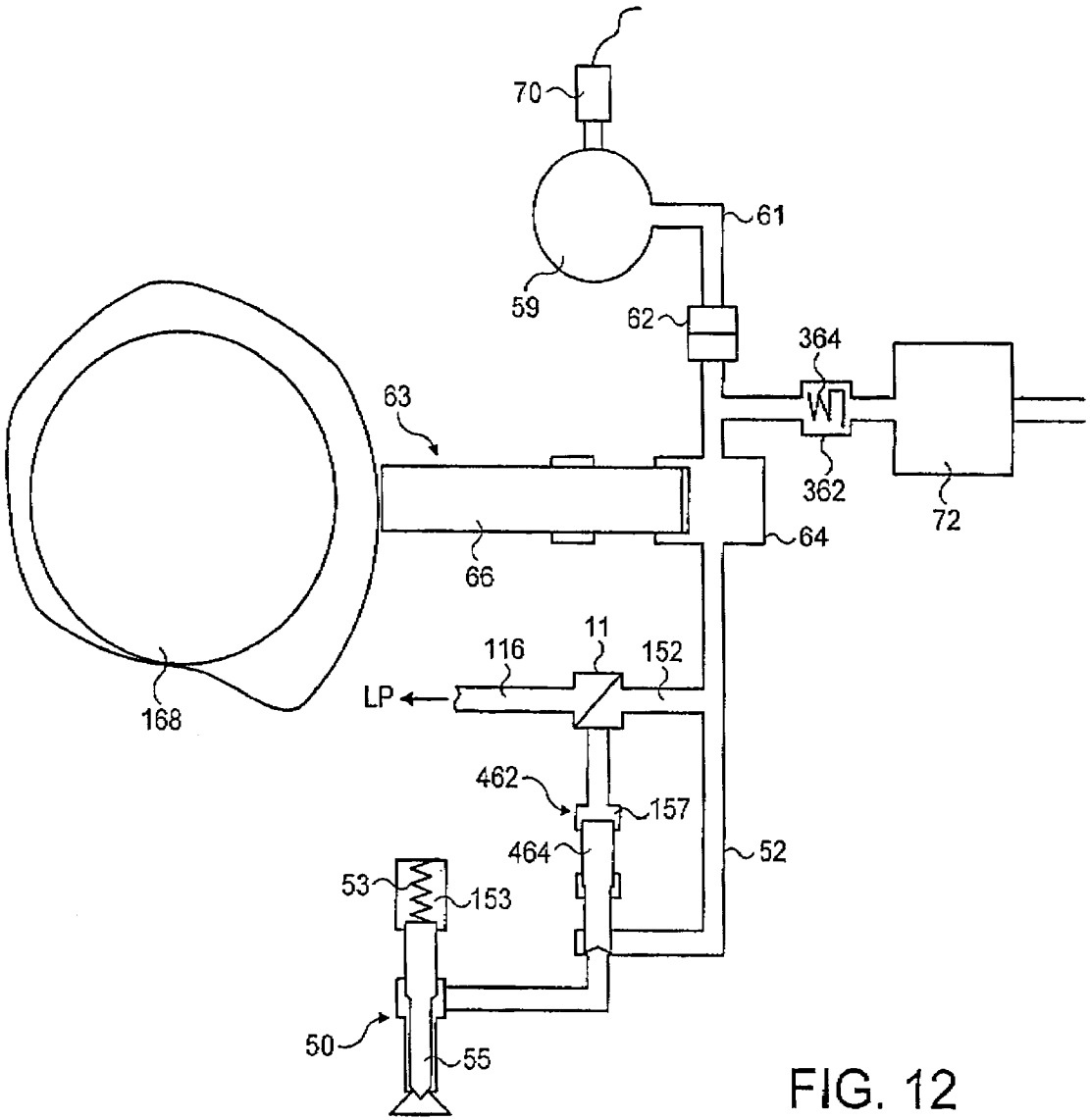
FIG. 12 is a further alternative embodiment of the fuel injection system incorporating a high pressure shut off valve.

In the embodiment shown in FIG. 12, the fuel injection system is therefore provided with control valve means in the form of a control valve 11 and a shut off valve arrangement 462 arranged within the high pressure fuel line 52. The control valve 11 is arranged to control fuel pressure within a control chamber 157 associated with the shut off valve 462, and thereby controls movement of the injector valve needle as described in further detail below. This configuration for controlling valve needle movement differs from the embodiments described previously, in that instead of providing a nozzle control valve 54 to control fuel pressure within an injector control chamber 57 at the back end of the valve needle, the control valve 11 acts to control fuel flow through the high pressure line 52 to the nozzle. In the embodiment of FIG. 12, the chamber 153 at the back end of the valve needle simply forms a chamber for housing the valve needle spring 53, and whether or not the valve needle is lifted from its seating to inject fuel is determined by opening and closing the shut off valve 462.

Figure 13:
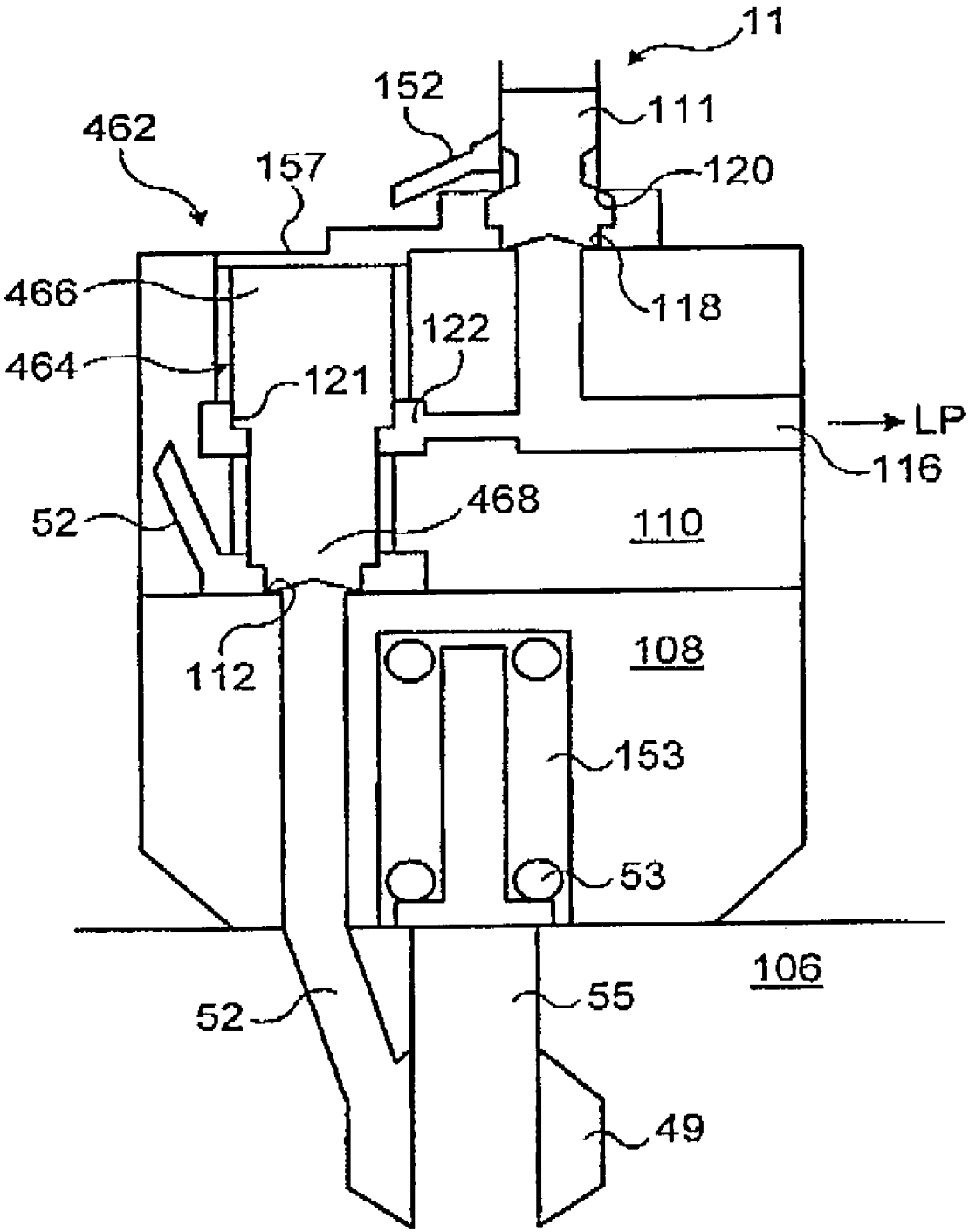
FIG. 13 is a schematic view of the high pressure shut off valve arrangement in the embodiment of FIG. 12.

One practical embodiment of the high pressure shut off valve 462, and its configuration in relation to the control valve 11 and the injector valve needle 55, is shown in further detail in FIG. 13. The shut off valve 462 includes a shut off valve member 464 that is arranged within the high pressure supply line 52 to the delivery chamber 49 of the injector. The chamber 153 at the back end of the valve needle 55 houses a spring 53 which serves to urge the valve needle 55 into a closed position. It can be seen in FIG. 13 that the valve needle 55, the chamber 153 and the shut off valve member 464 are housed in adjacently mounted housing parts 106, 108, 110.

The shut off valve member 464 is movable within a stepped bore 121 formed in the housing part 110 under the control of the control valve 11. In the operating condition shown in FIGS. 12 and 13, the shut off valve member 464 is in a first position (a "closed" operating position) in which the shut off valve member 464 is engaged with a shut off valve seating 112 defined by a surface of the housing part 108 so that the flow of fuel through the high pressure supply line 52 to the injector delivery chamber 49 is prevented. The shut off valve member 464 is movable away from the shut off valve seating 112 into a second position (an "open" operating position) in which the flow of fuel through the high pressure supply line 52 to the injector delivery chamber 49 is permitted.

The control valve 11 has a control valve member 111 which is movable between a first position (herein referred to as a closed position), in which a branch passage 152 from the high pressure supply line 52 communicates with a control chamber 157 at a back end of the shut off valve member 464 and communication between the control chamber 157 and a low pressure reservoir is closed, and a second position (herein referred to as an "open" position) in which the chamber 157 communicates with the low pressure reservoir through a drain passage 116 and communication between the branch passage 152 and the chamber 157 is broken. It cannot be fully appreciated from the scale of the drawing in FIG. 13, but the control valve member 111 is engaged with a first seating 118 when in its closed position to break communication between the chamber 157 and the drain passage 116 and is engaged with a second seating 120 when in its open position to open communication between the control chamber 157 and the drain passage 116 and to break communication between the branch passage 152 and the control chamber 157.

The shut off valve member 464 is movable between its open and closed positions in response to the hydraulic forces acting on surfaces of upper and lower end regions 466, 468 respectively of the valve member 464. The shut off valve member 464 is shaped to include upper and lower regions of different diameter. The upper end 466 has a first effective surface area exposed to fuel pressure within the control chamber 157. The lower end region 468 defines a surface area of annular form that is exposed to fuel pressure within the high pressure line 52 when the shut off valve member 464 is in its closed position, and when the shut off valve member is in its open position a second effective surface area is exposed to fuel pressure in the high pressure line 52. The first effective surface area of the upper end region 466 is greater than this second effective surface area of the lower end region 468. A gallery 122 defined in the region of the step in the bore 121 communicates continuously with the drain passage 116 to low pressure so as to prevent the occurrence of a hydraulic lock.

In use, the function of the shut off valve 462 is essentially the same in both the common-rail type and the EUI-type modes of operation (i.e. at both the first and second injectable pressure levels). If the control valve member 111 is moved to its open position in which it is seated against the second seating 120, the control chamber 157 communicates with the low pressure reservoir and hence the shut off valve member 464 will be urged away from the shut off valve seating 112 into its open position due to high fuel pressure within the supply line 52 (whether at pressure P1 or P2) acting on the exposed annular surface area of its lower end 468. Additionally, as the shut of valve member 464 starts to open, the lowermost end surface will also experience building pressure in the downstream portion of the high pressure line 52 and so eventually the entire end surface of the shut off valve member 464 (i.e. the second effective surface area) is exposed to high fuel pressure in the line 52. When the control valve member 111 is moved into this open state, fuel at either the first or second injectable pressure level is therefore able to flow through the open shut off valve 262, into the supply line 52 to the injector delivery chamber 49. As the pressure of fuel delivered to the delivery chamber 49, and hence to the downstream parts of the injector, a force is applied to the valve needle 55 that is sufficient to overcome the closing force of the spring 53 and, hence, fuel is injected to the engine.

If the control valve member 111 is moved into its closed position in which the control valve member 111 is moved away from the second seating 120 and is caused to seat against the first seating 118, high pressure fuel within the high pressure supply line 52 is able to flow through the branch passage 152 and into the control chamber 157 at the upper end 466 of the shut off valve member 464. As the first effective surface area of the shut off valve member 464 at its upper end 466 is greater than the second effective surface area of the shut off valve member 464 at its lower end 468 (i.e. the surface area experiencing fuel pressure within the high pressure line 52), this will cause the shut off valve member 464 to be urged against the shut off valve seating 112 into its closed position in a "plug type" fashion. As a result, the flow of fuel through the high pressure supply line 52 to the injector delivery chamber 49 is cut off, and the valve needle 55 is therefore urged closed by means of the force of the spring 53 overcoming reduced fuel pressure within the injector 50.

When the control valve 11 is actuated to terminate injection, the pressure of fuel delivered to the injector 50 will decay naturally, but rapidly, as injection continues to the associated engine cylinder. A point will be reached at which the force due to the valve needle spring 53 (in combination with the force due to any fuel pressure within the chamber 153) is sufficient to move the valve needle 55 to its seat and, hence, injection is terminated. Termination of injection in this manner has a similar characteristic to that of a spill-type end of injection, in that the valve needle 55 is urged to close against reducing or reduced fuel pressure within the injector 50.

In practice, the force of the valve needle spring 53 is preferably selected to be as low as practicable to ensure that substantially no high pressure fuel flows through the supply line 52 to the injector 50 when the valve needle 55 is at partial lift. In this way there is substantially no injection of fuel when the valve needle 55 is at partial lift. Typically, the spring 53 is selected so that the pressure of fuel in the high pressure supply line 52, whether initially at moderate rail pressure or at the second, higher pressure level, decays to around 200 bar before the valve needle 55 starts to close. In other words when fuel pressure decays to less than 200 bar the force due to the spring 53 is sufficient to seat the needle 55 against this fuel pressure. During closure, with the valve needle 55 in a partially lifted position (i.e. partial closure), there is a considerably reduced injection rate through the injection nozzle outlets and the pressure of fuel available for injection is therefore much reduced as the valve needle closes.

It will be appreciated, however, that there is a limit on how low the spring force can be, as there is also a requirement for the spring to be sufficient to ensure that cylinder gas pressure during combustion cannot unseat the valve needle 55.

It is a particular benefit of the shut off valve in FIG. 13 that the seat 112 for the shut off valve 462 and the stepped diameter of the shut off valve member 464 provide a particularly convenient valve construction for manufacturing purposes.

In an alternative embodiment of the shut off valve 462 shown in FIG. 13, the shut off valve member 464 may be substantially pressure-balanced to pressure upstream of the valve 462, so that the first effective surface area of the upper end 466 of the valve 464 exposed to fuel pressure within the control chamber 157 is substantially identical to the second effective surface area of the lower end region 468 of the valve member 464 that is exposed to fuel pressure within the high pressure line 52. In this embodiment, a suitable closing spring may be provided to provide the force imbalance required to cause the shut off valve 464 to close when the control valve 11 is moved into its closed position (in which the high pressure line 52 communicates with the chamber 157).

In a still further alternative embodiment, the shut off valve 462 may be shaped, by appropriate choice of its first and second effective surface areas, so that fuel that is supplied to the control chamber 157 is at a lower pressure than fuel supplied through the high pressure fuel line 52.

It will be appreciated that although the valve needle 55, the injector chamber 153 and the shut off valve member 464 are housed in adjacent housing parts 106, 108, 110 in the FIG. 13 embodiment, in practice these components 55, 153, 464 may be arranged in parts that are spaced from one another or may alternatively be arranged within a housing part that is common to one or more of the other components.

Figure 14:
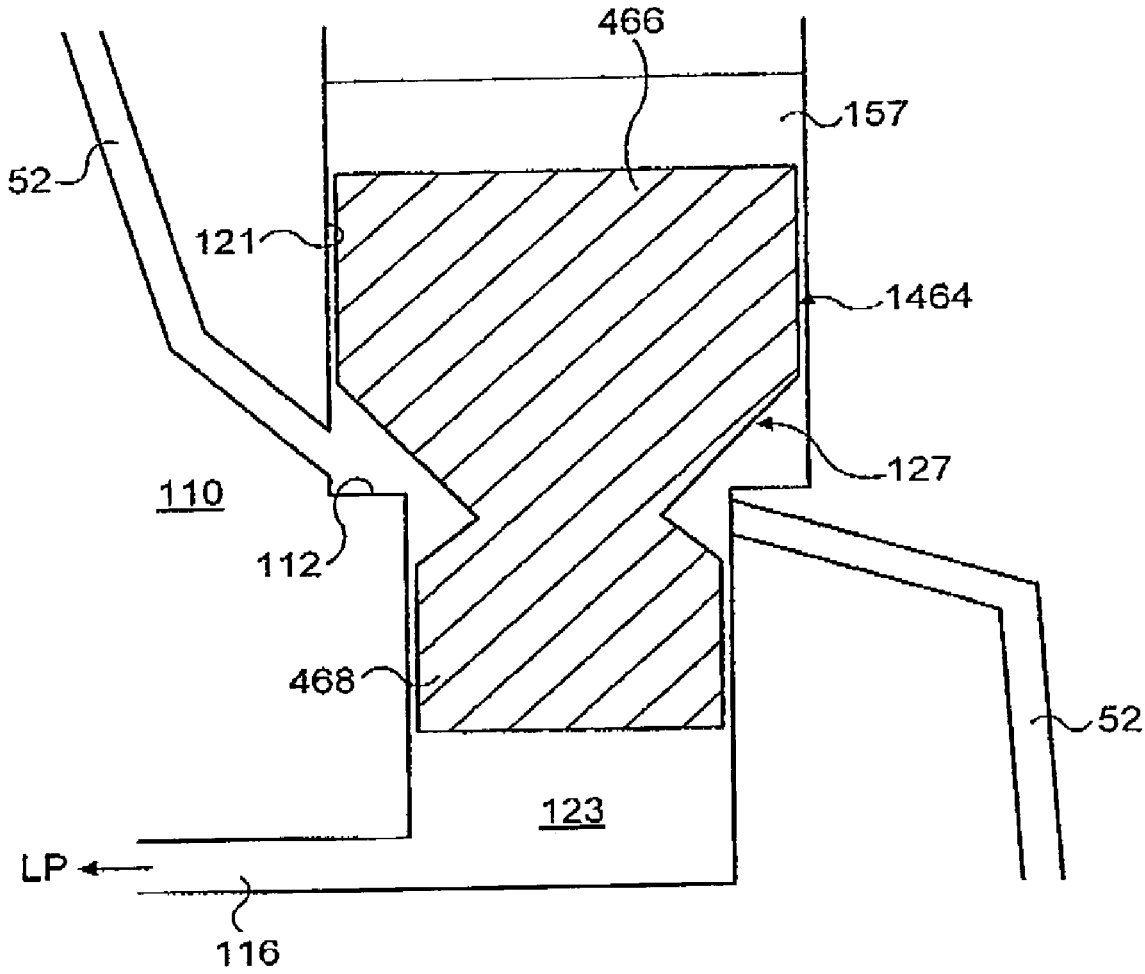
FIG. 14 is a schematic view of an alternative shut off valve member for us in the shut off valve arrangement in FIG. 13.

FIG. 14 shows an alternative construction of the shut off valve (again not pressure balanced). In FIG. 14, the shut off valve member 1464 includes an upper end 466, having a first diameter, that defines a surface exposed to fuel pressure within the control chamber 157, as in the FIG. 13 embodiment. The lower end 468 of the valve member 1464, however, having a second diameter, is exposed to fuel pressure within a chamber 123 in communication with a drain passage 116. The first diameter of the upper end 466 of the valve member 1464 is greater than the second diameter of the lower end of the valve member 1464. The valve member 1464 is guided within the bore 121 at its first and second diameter regions 466, 468. A seating surface 127 of substantially part-conical form is defined by an intermediate region of the shut off valve member 1464 between the first and second end regions 466, 468, and is engageable with a substantially flat shut off valve seating 1112. The seating surface 127 and the seating 1112 are shaped so that they engage over an annular region having a diameter substantially equal to the second diameter (or "guide" diameter) of the lower region 468 of the valve member 1464.

In this embodiment the first effective surface area of the valve member 1464 is defined by the upper end 466 of the valve member 1464, and the second effective surface area is defined by the differential area of the seating surface 127 (i.e. that area over which fuel within the high pressure line 52 acts when the valve member 1464 is seated, as determined by the difference in diameter between the upper and lower ends 466, 468).

As in the FIG. 13 embodiment, if the control valve 11 is operated so as to move the shut off valve member 1464 into engagement with the seating 1112, fuel within the high pressure supply line 52 is unable to flow to the delivery chamber 49 of the injector 55. If the control valve 11 is operated so as to move the shut off valve member 1464 away from the seating 1112 (i.e. de-pressurising the chamber 157), fuel within the high pressure supply line 52 is able to flow to the delivery chamber 49.

It is an advantage of the embodiment of the shut off valve in FIG. 14, that any out of balance forces acting on the valve member 1464 are substantially the same at all times i.e. with the valve 1464 in its open and closed positions. When the shut off valve member 1464 is in its seated position, an outer part of the conical surface 127 will be exposed to fuel flowing through the high pressure supply line 52 into the bore 121. As the shut off valve member 1464 starts to move away from the seating 1112 an annular chamber 125 is opened up to receive high pressure fuel from the supply line 52, and thus fuel flows through this chamber 125 to the downstream portion of the high pressure supply line 52. However, there is no change in the net hydraulic force acting on the valve member 1464 during opening. The flow of fuel being controlled by opening and closing the valve 462 (i.e. the flow through the high pressure supply line 52) therefore has substantially no hydraulic influence on the valve member 1464 as it opens.

In comparison with this, as the shut off valve member 1464 of the FIG. 13 embodiment starts to open, high pressure fuel within the supply line 52 will act on the entire end surface of the lower end 468 of the valve member 464. It has been found that the shut off valve design incorporating the conical seating 127 and, hence, the annular chamber 125 for receiving high pressure fuel from the supply line 52, improves the balancing of forces on the shut off valve member 1464.

It is a further feature of the shut off valve of the FIG. 14 embodiment that the differential area of the surface 127 (i.e. that area exposed to high pressure within the line 52 when the valve member 1464 is seated) is small compared with the much larger effective area of the upper region 466 that experiences high fuel pressure as the chamber 157 is re-pressurised when the control valve 11 is closed. The combination of a relatively small "opening" area and a relatively large "closing area" is particularly advantageous for enabling a pilot injection of fuel in which only a small quantity of fuel is delivered.

It will be appreciated that the advantageous features of the shut off valve 1462 in FIG. 14 may be achieved if a valve seating of frusto-conical form is used, as opposed to a substantially flat seating such as 1112, by providing a shut off valve member 1464 having an appropriate differential area.

It is a further advantage of the shut off valve arrangement 462, either as shown in FIG. 13 or FIG. 14, that it is possible to achieve a "pulsed" injection of fuel to the engine, whilst the valve needle 50 is in a lifted position. This may be achieved by controlling the control valve 11 so as to cause the shut off valve 462 to move rapidly between its open and closed positions, such that the supply of high pressure fuel through the supply line 52 is halted or varied. When the supply of fuel to the injector 50 is halted, injection is interrupted or significantly reduced.

For example, if the control valve 11 is actuated to open the shut off valve 464, 1464 fuel is supplied to the injector 50 and the valve needle 55 lifts from its seating to commence injection. The control valve 11 is then switched rapidly to close the shut off valve 462, halting the flow of fuel to the injector, and is then switched rapidly to open the shut off valve 464, 1464 to allow fuel flow to the injector 50 once again. The response of the valve needle 55 is slower than that of the shut off valve 462, and so throughout these actuation steps of the control valve 11 the valve needle 55 does not re-seat against the valve needle seating. The injection of fuel is therefore interrupted.

This method is particularly useful for achieving a pilot injection of fuel followed by a main injection of fuel, for example as shown in FIG. 6, and the "pulsing" of injection in this way may be achieved more rapidly by actuation of the control valve 11 to open and close the shut off valve 462 than can be achieved by opening and closing the valve needle 55 by means of a nozzle control valve (such as item 54 in FIG. 8). It is by virtue of the slow response of the valve needle 55 that injection pulsing can be achieved. The added benefit of using the shut off valve 462 to "pulse" injection is that, as referred to previously, there is no requirement to shut or seat the valve needle against high fuel pressure in the nozzle, so that fuel spray degradation problems are avoided.

If it is required that the pilot injection of fuel is at a lower injectable pressure (e.g. the first, moderate injectable pressure), than the main injection of fuel, the rail control valve 62 may be operated independently during the period between opening and closure of the shut off valve 462 to interrupt injection so as to increase the pressure that is delivered through the high pressure supply line 52. This may be done at or about the same time as the shut off valve 462 is opened again to re-start injection (i.e. the next injection pulse), or may be done at any time depending on the particular injection characteristic that is required.

It will be appreciated that any of the valves 62, 162, 262 described previously may preferably, but need not, be electrically or electromagnetically operated by energisation or de-energisation of an electromagnetic actuator winding. It will further be appreciated that references to "actuation of a valve" to cause a valve to move between its operating positions may, for an electromagnetically operable valve, be implemented either by increasing the energisation level of the actuator winding or by decreasing the energisation of the winding to cause said movement. Other forms of valve actuation means would, however, be envisaged by those skilled in the art, both hydraulic and/or mechanical, whilst still achieving the required valve functions.

For any of the embodiments of the invention described previously, typically the system may be operated so as to achieve injection at a first pressure level that is significantly lower than the second pressure level, for example so as to permit a pilot injection of fuel at pressure P1 to be followed by a main injection of fuel at pressure P2 (as shown in FIG. 6), or to permit a boot-shaped injection event to be achieved (as shown in FIG. 7). For example, the second pressure level that is achieved with the rail control valve 62 closed may be between 5 and 10 times higher than the first pressure level that is achieved when the rail control valve 62 is open.

One practical embodiment of the fuel system of the present invention, as for any of the embodiments described previously, is shown in FIG. 15. For clarity, corresponding features to those shown in FIGS. 3 to 5 are denoted with the same reference numerals. The cam drive arrangement includes a cam follower 124 that rides over the surface of the cam 68 as the cam rotates and is arranged to impart drive to a drive member 126, for example in the form of a tappet, that is coupled to the plunger 66. The drive member 126 is driven under the influence of the cam arrangement 68, 124 to reciprocate within a cylinder 128 and, thus, imparts reciprocating movement to the plunger 66. A pin 130 is secured to the drive member 126, and a return spring 132 is mounted upon a shaft 134 of the engine which cooperates with the pin 130 so as to return the drive member 126 and follower mechanism as the follower 124 rides over a falling flank of the cam 68. The plunger 66 is arranged to be substantially perpendicular to the axis of the injector.

Figure 15:
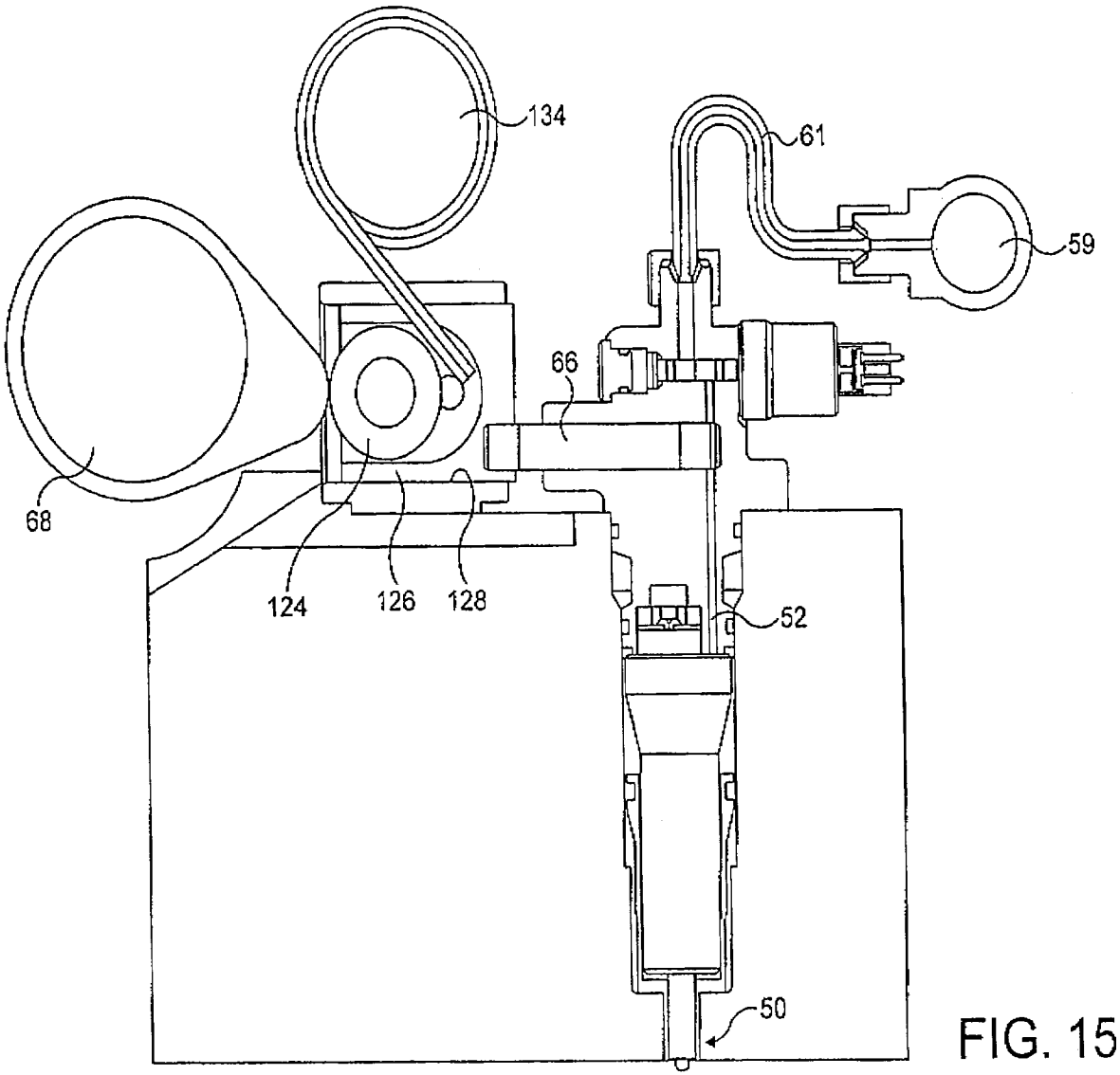
FIG. 15 shows a sectional view of one practical embodiment of the fuel injection system described with reference to FIGS. 3 to 13.

As can be seen in FIG. 15, the diameter of the common rail 59 is smaller than that of the shaft 134. It is possible to use a common rail 59 of relatively small size, as it need only be charged with fuel at the first, moderate pressure level due to the provision of the pump arrangement 63 and the rail control valve 62 which permit an increased pressure level to be supplied to the injector 50 when the rail control valve 62 is closed. By way of example, the moderate pressure of fuel within the rail may be around 300 bar, compared with pressures around 2000 bar in known common rail systems. As the common rail 59 may be of relatively small size, it is possible to house the rail 59 within another component of the engine.

In an alternative configuration to that shown in FIG. 15, the shaft 134 may be the engine rocker shaft and may be hollow so that the rail may extend through a region of the hollow shaft. As a further alternative the rail may be provided within a region of an engine cylinder head.

It will be appreciated that the fuel injection system of any of the embodiments described previously, and not just that in FIGS. 3 to 5, may be implemented as in FIG. 15.

Obviously, many modifications and variations of the present invention are possible in light of the above teachings. The invention may be practiced otherwise than as specifically described within the scope of the appended claims.

What is claimed is:

1. A fuel injection system for supplying pressurised fuel to a fuel injector, the fuel injection system comprising:

an accumulator volume for supplying fuel at a first injectable pressure level to the fuel injector through a fuel supply passage;

a pump arrangement for increasing the pressure of fuel supplied to the injector to a second injectable pressure level, the pump arrangement including a pump chamber defined within a plunger bore, and a plunger which is movable within the plunger bore to cause pressurization of fuel within the pump chamber; and a valve arrangement disposed in the fuel supply passage between the pumping chamber and the accumulator volume and operable between a first position in which i) fuel at the first injectable pressure level is supplied to the fuel injector and ii) the pump chamber is in communication with the accumulator volume such that fuel at the first injectable pressure level may flow from the accumulator volume to the pump chamber, and fuel at the first injectable pressure level is supplied to the injector and a second position in which communication between the injector and the accumulator volume is broken so as to permit fuel at the second injectable pressure level to be supplied to the fuel injector.

2. The fuel injection system as claimed in claim 1, wherein the pump arrangement and the injector are combined in a common unit.

3. The fuel injection system as claimed in claim 1, wherein the pump arrangement includes a cam drive arrangement having a cam for imparting drive to the plunger.

4. The fuel injection system as claimed in claim 3, wherein the cam includes a first cam lobe and at least one further cam lobe, whereby the first cam lobe effects pressurisation of fuel within the pump chamber to the second pressure level during at least a part of a first pumping stroke of the plunger, and a further one of the lobes effects pressurisation of fuel within the pump chamber to the first pressure level during a further pumping stroke of the plunger.

5. The fuel injection system as claimed in claim 3, including a plurality of injectors, each having an associated pumping plunger for performing a pumping stroke and a return stroke, and whereby each of said plungers is driven by means of an associated cam that is oriented relative to the or each of the other cams and has a surface shaped such that the associated return stroke is interrupted to define at least one step of plunger movement that is substantially synchronous with the pumping stroke of one of the other plungers.

6. The fuel injection system as claimed in claim 5, wherein each cam surface is shaped to include a rising flank, and wherein the remainder of the cam surface includes a surface irregularity which serves to define an interval of interruption in the return stroke of the associated plunger.

7. The fuel injection system as claimed in claim 5, wherein each cam is driven by means of a shaft, in use, and wherein each cam surface is shaped to define a number of steps of movement through the associated return stroke that is equal to the number of other cams driven by the same shaft.

8. The fuel injection system as claimed in claim 3, wherein the pump arrangement further comprises a drive member which is co-operable with the plunger, wherein the drive member is coupled to a rocker arm of the engine such that movement of the drive member imparts pivotal movement to the rocker arm.

9. The fuel injection system as claimed in claim 1, wherein the valve arrangement includes a valve for controlling communication between the pump arrangement and the accumulator volume.

10. The fuel injection system as claimed in claim 9, further comprising a high pressure fuel pump for supplying fuel at the first injectable pressure level to the accumulator volume.

11. The fuel injection system as claimed in claim 1, wherein the valve arrangement includes an electrically operable valve member which is movable between its first and second positions by application of an electronic control signal.

12. The fuel injection system as claimed in claim 1, wherein the valve arrangement includes a three-position valve that is operable between the first and second positions and a further, third position in which the pump arrangement communicates with a low pressure drain, thereby to permit spill-end of injection.

13. The fuel injection system as claimed in claim 12, wherein the three-position valve includes an inner valve member and an outer valve member, and associated inner and outer valve spring arrangements, whereby movement of the inner and outer valve members is effected by means of a winding of an electromagnetic actuator.

14. The fuel injection system as claimed in claim 13, wherein the outer valve member is coupled to an armature of the actuator, said outer valve member being movable relative to the inner valve member and being movable into engagement with a first valve seating defined by the inner valve member upon energisation of the winding to a first energisation level, thereby to move the valve arrangement into the third position, said movement of the outer valve member being coupled to the inner valve member to move the valve arrangement into the second position upon energisation of the winding to a second energisation level.

15. The fuel injection system as claimed in claim 1, wherein the pump arrangement is operable to supply pressurised fuel, at the first injectable pressure level to the accumulator volume.

16. The fuel injection system as claimed in claim 15, wherein the valve arrangement further includes an additional valve for controlling a supply of fuel at relatively low pressure to the pump arrangement.

17. The fuel injection system as claimed in claim 16, wherein the additional valve is a fill/spill valve that is actuable between an open position, in which the pump arrangement communicates with the supply of fuel at relatively low pressure, and a closed position in which said communication is broken, and whereby actuation of the fill/spill valve to the open position during a pumping stroke permits a spill-end of injection.

18. The fuel injection system as claimed in claim 16, wherein the additional valve is a non-return valve having an open position, in which the pump arrangement communicates with the supply of fuel at relatively low pressure, and a closed position in which said communication is broken.

19. The fuel injection system as claimed in claim 16, further comprising a transfer pump for supplying fuel at relatively low pressure to the pump arrangement.

20. The fuel injection system as claimed in claim 1, wherein the injector includes a control valve arrangement operable to control the timing of commencement of injection at the first and/or second injectable pressure level.

21. The fuel injection system as claimed in claim 20, wherein the control valve arrangement includes a nozzle control valve that is operable to control fuel pressure within an injector control chamber, so as to permit control of injection timing at the first and/or second injectable pressure level.

22. The fuel injection system as claimed in claim 21, wherein the injector includes a valve needle having a surface exposed to fuel pressure within the control chamber.

23. The fuel injection system as claimed in claim 20, wherein the control valve arrangement includes a shut off control valve, including a shut off valve member, for controlling the supply of fuel between the pump arrangement and the injector, thereby to permit control of injection timing at the first and/or second injectable pressure level.

24. The fuel injection system as claimed in claim 23, wherein the control valve arrangement further includes a control valve for controlling fuel pressure within a shut off valve control chamber, wherein a surface associated with the shut off control valve member is exposed to fuel pressure within the shut off control chamber.

25. The fuel injection system as claimed in claim 1, wherein the pump arrangement is operable to raise fuel pressure to a second injectable pressure level in the range of 2000 and 2500 bar.

26. The fuel injection system as claimed in claim 1, whereby the fuel in the accumulator volume is at a pressure level of between 200 and 300 bar.

27. The fuel injection system as claimed in claim 1, wherein the second injectable pressure is between 5 and 10 times higher than the first injectable pressure level.

28. The fuel injection system as claimed in claim 1, wherein the accumulator volume is comprised in a rocker shaft of the associated engine.

29. A shut off valve for use in a fuel injection system including an injector, the shut off valve control valve including a shut off valve member that is operable between open and closed operating positions to control the supply of fuel to the injector, the shut off valve member having a surface exposed to fuel pressure within a shut off control chamber, the shut off valve further comprising a control valve for controlling fuel pressure within the shut off valve control chamber, thereby to control movement of the shut off valve member between the open and closed operating positions.

30. The shut off valve as claimed in claim 29, wherein the shut off valve member is arranged within a fuel supply passage to the injector and such that an associated first surface of the shut off valve member defines a first effective surface area that is exposed to fuel pressure within the shut off control chamber and an associated second surface of the shut off valve member defines a second effective surface area, whereby the associated second surface of the shut off valve member is engageable with a shut off valve seating to control fuel flow through the fuel supply passage.

31. The shut off valve as claimed in claim 30, wherein the associated second surface defines a seating surface of substantially conical form for engagement with the shut off valve seating.

32. The shut off valve as claimed in claim 31, wherein the associated second surface is defined by an intermediate region of the shut off valve member.

33. The shut off valve as claimed in claim 30, wherein the associated first surface is defined by a first end region of the shut off valve member and an opposite end region of the shut off valve member is exposed to relatively low fuel pressure.

34. The shut off valve as claimed in claim 30, wherein the shut off valve member is shaped such that any force imbalance on the shut off valve member is substantially the same when the shut off valve member is in both its open and closed operating positions.

35. The shut off valve as claimed in claim 30, wherein the shut off valve member is slideable within a bore in a valve housing and is shaped to define, together with the bore, an annular chamber through which high pressure fuel flows when the shut off valve member is in the open operating position.

36. The shut off control valve as claimed in claim 30, wherein the associated first surface is defined by a first end region of the shut off valve member and the associated second surface of the shut off valve member is defined at an opposite end region of the shut off valve member.

37. The shut off valve as claimed in claim 36, wherein the associated second surface is engageable with a shut off valve seating defined by an end face of a housing part.

38. The shut off valve as claimed in claim 29, for use in a fuel injection system for injecting fuel at an injectable pressure level, wherein the control valve is operable between a first position in which the shut off valve control chamber communicates with fuel at the injectable pressure and a second position in which the shut off valve control chamber communicates with fuel at a relatively low pressure.

39. The shut off valve as claimed in claim 29, for use in a fuel injection system for injecting fuel at an injectable pressure level, wherein the control valve is operable between a first position in which the shut off valve control chamber communicates with fuel at a pressure level that is different to the injectable pressure level and a second position in which the shut off valve control chamber communicates with fuel at a relatively low pressure.

40. The shut off valve as claimed in claim 29, wherein the shut off valve member is substantially pressure balanced, and includes a spring arrangement for urging the shut off valve member towards its closed position.

41. The shut off valve as claimed in claim 29, wherein the shut off valve member is not pressure balanced.

42. The shut off valve as claimed in claim 41, wherein the first effective surface area of the first associated surface is greater than the second effective surface area of the second associated surface.

43. A fuel injection system for supplying pressurised fuel to a fuel injector, said fuel injection system comprising:

an accumulator volume for supplying fuel at a first injectable pressure level to the fuel injector through a fuel supply passage;

pump means for increasing the pressure of fuel supplied to the injector to a second injectable pressure level;

valve means operable between a first position in which fuel at the first injectable pressure level is supplied to the injector and a second position in which communication between the injector and the accumulator volume is broken so as to permit fuel at the second injectable pressure to be supplied to the injector; and control valve means including a shut off control valve, including a shut off valve member, for controlling the supply of fuel between the pump means and the injector, and arranged to enable control of injection timing at the first and/or second injectable pressure level.

44. A fuel injection system for supplying pressurised fuel to a fuel injector, the fuel injection system comprising:

an accumulator volume for supplying fuel at a first injectable pressure level to the fuel injector through a fuel supply passage;

a pump arrangement for increasing the pressure of fuel supplied to the injector to a second injectable pressure level, and a three position valve operable between a first position in which fuel at the first injectable pressure level is supplied to the injector, a second position in which communication between the injector and the accumulator volume is broken so as to permit fuel at the second injectable pressure to be supplied to the injector and a third position in which the pump arrangement communicates with a low pressure drain, thereby to permit spill-end of injection.

* * * * *